US007527354B2

(12) United States Patent
Udagawa

(10) Patent No.: US 7,527,354 B2
(45) Date of Patent: May 5, 2009

(54) RECORDING SYSTEM

(75) Inventor: Kenichi Udagawa, Tokyo (JP)

(73) Assignee: Canon Finetech Inc., Misato-shi (JP)

( * ) Notice: Subject to any disclaimer, the term of this patent is extended or adjusted under 35 U.S.C. 154(b) by 356 days.

(21) Appl. No.: 11/312,483

(22) Filed: Dec. 21, 2005

(65) Prior Publication Data

US 2006/0152546 A1 Jul. 13, 2006

(30) Foreign Application Priority Data

Jan. 7, 2005 (JP) ..... 2005-002044
Feb. 25, 2005 (JP) ..... 2005-050044

(51) Int. Cl.
*B41J 2/14* (2006.01)
*B41J 2/01* (2006.01)

(52) U.S. Cl. ..... 347/49; 347/104

(58) Field of Classification Search ..... 347/42, 347/49, 104
See application file for complete search history.

(56) References Cited

U.S. PATENT DOCUMENTS 5,706,038 A * 1/1998 Jackson et al. ..... 347/33
5,786,830 A * 7/1998 Su et al. ..... 347/33
6,364,451 B1 * 4/2002 Silverbrook ..... 347/42

FOREIGN PATENT DOCUMENTS

| | | |
|---|---|---|
| JP | 7-076093 | 3/1995 |
| JP | 2001-113690 | 4/2001 |
| JP | 2003-127352 | 5/2003 |
| JP | 2004-025627 | 1/2004 |
| WO | WO 2004/106068 | 12/2004 |

* cited by examiner

*Primary Examiner*—An H Do
(74) *Attorney, Agent, or Firm*—Fitzpatrick, Cella, Harper & Scinto

(57) ABSTRACT

A recording system includes a first recording unit, including a recording module having a recording head and a cleaning unit which cleans the recording head, a conveying section which conveys a recording medium, and at least a second recording unit provided at a downstream side in a conveying direction of the recording medium, wherein the first recording unit records a first image portion and the second recording unit records a second image portion.

19 Claims, 28 Drawing Sheets

| FIG. 14A | FIG. 14B |
|---|---|

| FIG. 15A | FIG. 15B |
|---|---|

| FIG. 24A | FIG. 24B |
|---|---|

RECORDING SYSTEM

BACKGROUND OF THE INVENTION

1. Field of the Invention

The present invention relates to a large-sized recording system employing a recording module having a recording head in plural units.

The present invention also relates to a recording apparatus, a conveying apparatus and a recording system in which a recording operation is achieved by sharing among plural recording units.

2. Related Background Art

In a prior recording system for printing a recording medium of a relatively large size with a line head, in case the ink discharge is not executed for a certain period in a part of plural ink discharge nozzles in the recording head, such nozzles may be dried to induce a viscosity increase in the ink, whereby a proper recording performance may not be maintained.

In order to maintain the recording performance and the continuity in the recording operation, there is proposed a recording apparatus which, utilizing an interval of recording sheets after the lapse of a predetermined time, executes a forced ink discharge in a holed part of a conveying belt before a next recording sheet is supplied (for example cf. Japanese Patent Application Laid-open No. 2001-113690).

Also utilizing the recent remarkable progress in the recording resolution with a sufficiently small ink amount in a single discharge, there is proposed a method of dispersing preliminary discharges, separate from discharges for image data, in a marginal area so as to be visually unnoticeable thereby maintaining the proper discharge performance of the nozzles (for example cf. Japanese Patent Application Laid-open No. 2004-25627).

On the other hand, in case the ink discharges are concentrated as a burst or in case a cumulative number of pixel recordings on a same nozzle exceeds a certain number, an ink drop may be formed in the vicinity of such nozzle whereby a proper recording performance may not be maintained locally.

Therefore, in order to maintain a proper recording performance, the recording operation is interrupted after the ink discharge of a predetermined amount in a certain nozzle area and a wiping (cleaning) operation by a wiper blade or the like for wiping off the ink in the vicinity of the nozzle is inserted.

In order to reduce the time of interruption by such cleaning operation, there is proposed a structure of providing plural recording heads, and, during the cleaning operation for a recording head in the course of a recording operation, switching the recording operation to the other recording head (for example cf. Japanese Patent Application Laid-open No. 7-76093).

As to the preliminary discharge for refreshing the nozzles at every predetermined time, it can now be suppressed to a visually unnoticeable level by dispersing the discharges according to the method of Japanese Patent Application Laid-open No. 2004-25627 mentioned above. However, in the wiping (cleaning) operation by a wiper blade or the like for wiping off the ink in the vicinity of the nozzle, the recording operation of the head has to be temporarily interrupted according to the methods described in Japanese Patent Application Laid-open Nos. 2001-113690 and 2004-25627.

Also the method described in Japanese Patent Application Laid-open No. 7-76093 may significantly reduce the time of interruption during the cleaning operation, while, with respect to the continuousness of recording operation and continuity of the recording, it is effective for images sectioned by each recording medium or each page, but a slight interruption in the recording operation occurs by the switching of the recording heads in case of a high-speed recording on a continuous sheet with a small label interval as in the case of a label printer, and, in case the image changes continuously as in cloth pattern printing, a wallpaper printing or a form printing, a cumbersome sheet returning operation is required even for such slight interruption in order to secure continuity in the image recorded after the interruption.

Also in the performance of the recording apparatus, despite of the presence of plural recording heads, a maximum possible recording speed cannot be attained. In other words, it is limited to a recording speed always in consideration of a speed decrease resulting from the interruption of recording in the heat to be cleaned.

Also in a recording apparatus for a high-speed image formation on a relatively wide recording sheet with plural recording heads or plural recording head modules, there is known a configuration of positioning carriages, supporting such recording head modules, to the respective recording positions by independent guide shafts (for example Japanese Patent Application Laid-open No. 2003-127352).

Also recently known is a wide-format recording apparatus in which the recording area is shared among plural recording apparatuses arranged in a staggered fashion along the transversal direction of the recording sheet (for example PCT/JP2004/007912).

However, in the configuration described in Japanese Patent Application Laid-open No. 2003-127352, requiring a carriage and a carriage sliding unit independent for each recording module, the space of the entire mechanism in the sheet conveying direction increases substantially proportionally to the recording width. Also in order to continue the recording operation during the cleaning operation of the recording head in the course of the recording operation, at least two recording modules have to be provided, so that the space in the sheet conveying direction is at least doubled.

Also the configuration described in PCT/JP2004/007912 involves an interruption in time during the cleaning operation. Also the recording apparatus for each recording area functions independently, a displacement in the recording position inevitably occurs at each up-down motion of the recording head. Consequently the continuity of image is slightly perturbed at the boundary of the areas of the recording apparatuses, and, in order to avoid such perturbation, the image to be recorded has to be prepared under certain restriction.

SUMMARY OF THE INVENTION

The present invention has been made to solve the aforementioned various drawbacks, and has realized followings.

More specifically, a recording system of the present invention includes:

a first recording unit including recording modules, each having a recording head and cleaning means which cleans the recording head, in plural units along a direction of width of a recording medium;

conveying means which conveys the recording medium; and at least a second recording unit provided at a downstream side in the conveying direction of the recording medium;

wherein the first recording unit records a first image portion and the second recording unit records a second image portion.

The recording system of the present invention further includes cleaning operation control means which controls cleaning operations of the recording units independently.

The recording system of the present invention further includes conveying speed setting means which sets a conveying speed of the recording medium in a state where the first and second recording units are not in a cleaning operation, at least equal to a conveying speed during a cleaning operation.

The present invention allows to provide a recording system having a higher image quality and a higher productivity, while basically retaining the continuity in image.

The present invention provides a particularly conspicuous effect in case of employing three or more recording heads, for constructing a recording system capable of recording a sharp image by a constant multi-path (three-path or more, or two-path or more) recording without interruption and thus producing an image an extremely high image quality with a high reliability.

Furthermore, a recording apparatus or a recording system of the present invention includes plural positioning pins in a movable part mounted with a recording module including a recording head, and, in a fixed part of a sheet conveying portion, guide portions for guiding the positioning pins.

When the movable part moves downward and reaches a vicinity of a position for recording operation, it so moves as to converge to a constantly same position with respect to a recording medium.

According to the present invention, in case the recording head is retracted, in the course of a recording operation, to a cleaning position for a cleaning operation thereof and is then returned again to a recording position, the recorded image scarcely shows an aberration whereby a recording apparatus and a recording system of a high speed and a high image quality can be provided.

Still other objects of the present invention, and advantages thereof, will become fully apparent from the following detailed description of embodiments of the invention, which is to be taken in conjunction with the accompanying drawings.

DETAILED DESCRIPTION OF THE PREFERRED EMBODIMENTS

Now best modes for executing the present invention will be explained with reference to the accompanying drawings.

First Embodiment

Figure 1:
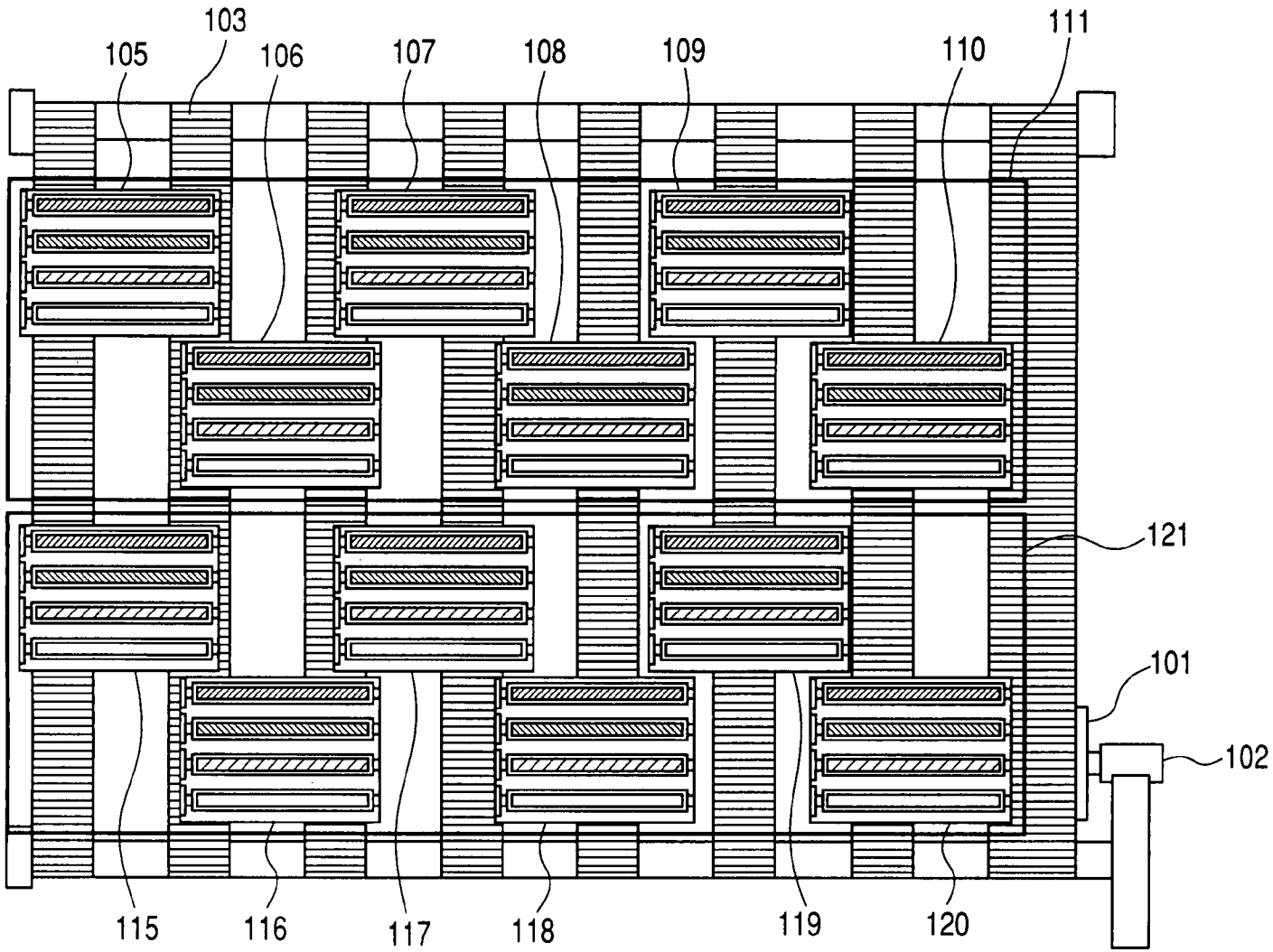
FIG. 1 is a plan view showing a stand-by state of a recording system in a first embodiment of the present invention.

FIG. 1 is a schematic view showing a configuration seen from above of a recording system of the present invention.

Two recording units 111, 121 are respectively constituted of recording modules 105-110 and 115-120, each having four line heads with 2560 nozzles at a resolution of 600 dot/inch. A maximum recording width per recording module is therefore about 4.3 inches, but an overlapping area is required as illustrated between adjacent recording modules in order to secure a continuity of image in the direction of width, and a staggered arrangement of 6 recording modules in the direction of width of a recording medium provides, in consideration of the above-mentioned overlapping areas, a rated maximum recording width of 24 inches. The recording medium is conveyed from above to below in the drawing, on plural conveying belts 103, by a driving gear 102 coupled with a rotary shaft and driven by a sheet conveying motor 101, and is subjected to a high-speed image recording upon passing under the recording units 111, 121. For the purpose of clarity, substrates for the recording units 111, 121 are represented as a semi-transparent members.

Four recording heads in each recording module are for K (black), C (cyan), M(magenta) and Y (yellow) colors, but they may also be for a same color. FIG. 1 shows a stand-by state in which all the recording heads are capped by capping mechanisms, as will be explained later in more detail.

Figure 2:
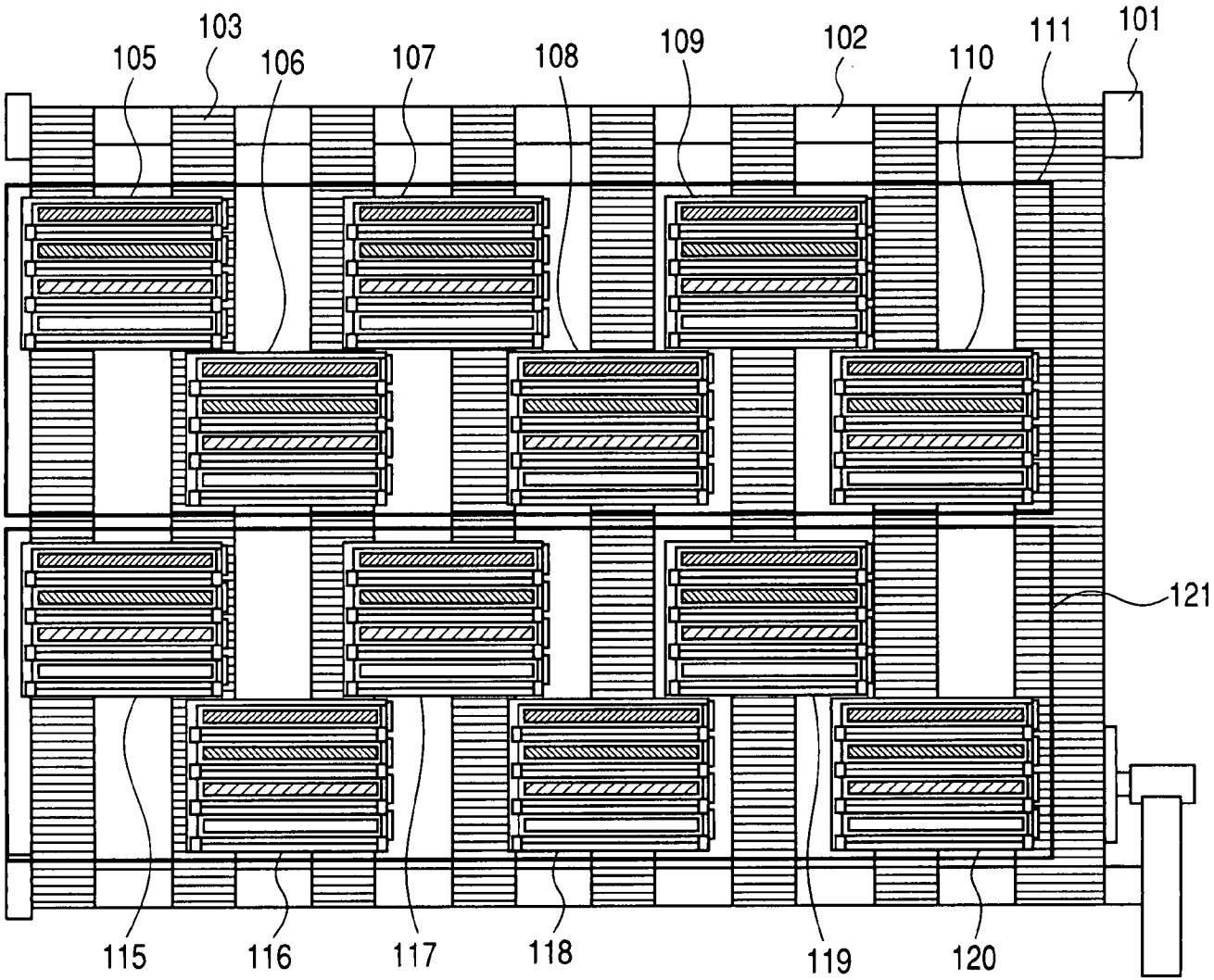
FIG. 2 is a plan view showing a recording operation state of the recording system in the first embodiment of the present invention.

FIG. 2 shows a state in which, for preparing for a recording operation, all the capping mechanisms are displaced in the vertical direction in the drawing, by a thickness dimension of each recording head plus a small distance to wait for the recording medium to be conveyed, as will be explained later in more detail.

Figure 3:
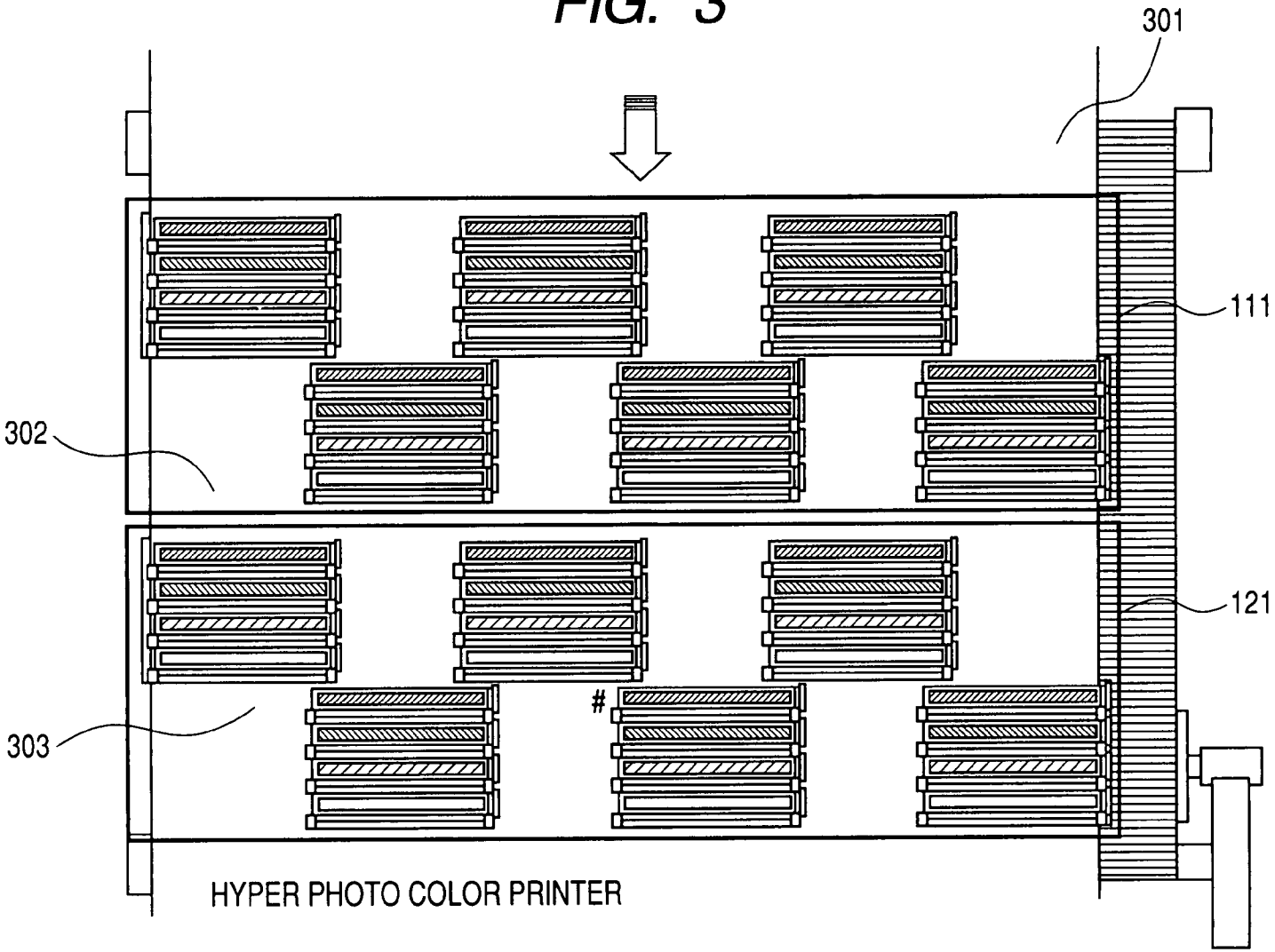
FIG. 3 is a schematic view showing a state of a recording operation by both recording units in the recording system of the above-mentioned embodiment.

FIG. 3 shows a state in which a recording medium 301 is conveyed with a substantially constant speed in a direction indicated by an arrow, and is subjected to an image formation upon passing under the two recording units 111, 121.

An image 302 formed by passing under the recording unit 111 is a portion corresponding for example to odd-numbered rasters, and is complemented by remaining even-numbered rasters upon passing under the recording unit 121 of the downstream side, thereby providing a completed image 303. In this state, therefore, the recording operation is shared by the recording units 111 and 121. Such shared recording method is called multi-path recording (two-path recording in this embodiment), which provides an advantage that the image quality can be significantly improved because the recording characteristics can be dispersed to the plural nozzles, in comparison with a case of a continuous image formation by a single head.

In the following, a basic structure of the recording modules 105-110 and 115-120 will be explained with reference to FIGS. 4A and 4B.

Figure 4A:
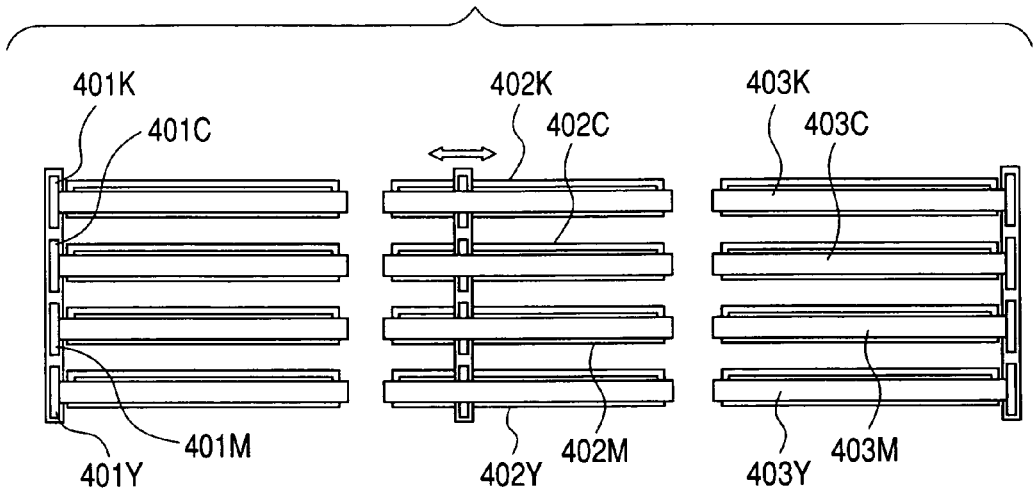
FIGS. 4A and 4B are schematic views showing a wiping operation in recording modules of 4- and 6-color structure.
Figure 4B:
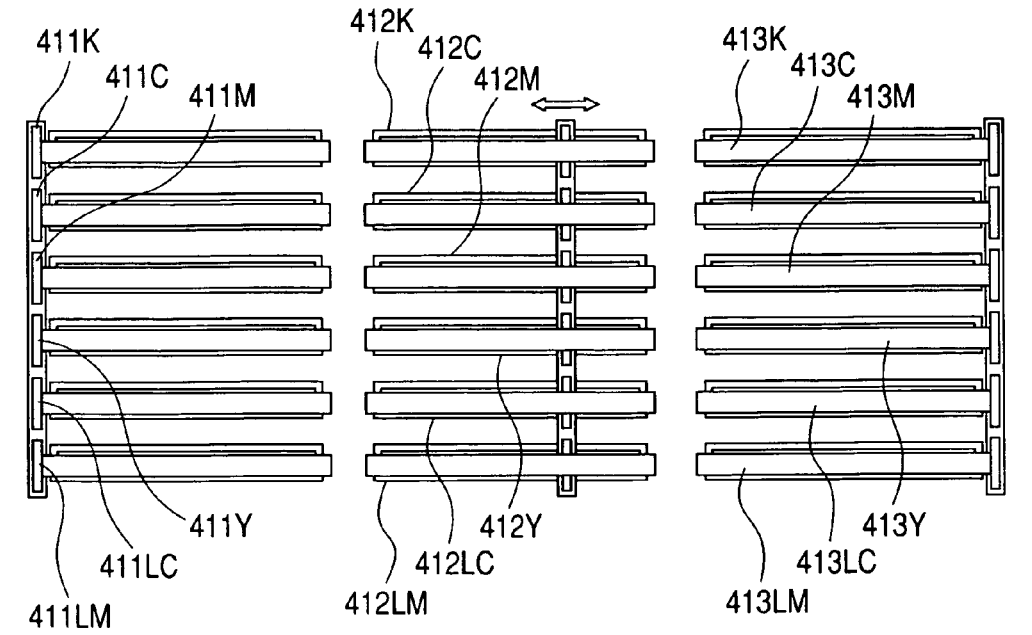

FIG. 4A shows a 4-color recording module with K (black), C (cyan), M (magenta) and Y (yellow) colors, and FIG. 4B shows a 6-color recording module with K (black), C (cyan), M (magenta), Y (yellow), LC (light cyan) and LM (light magenta) colors.

Since these modules are different only in the number of colors, following description will be made on 6-color structure shown in FIG. 4B.

FIG. 4B shows, in a plan view seen from above, wiper blades 411K-411LM, capping mechanisms 412K-412LM and recording heads 413K-413LM.

The wiper blades 411K-411LM can laterally move above the capping mechanisms 412K-412LM to wipe nozzle arrays (not shown) provided in lower parts of the recording heads 413K-413LM thereby cleaning the nozzles faces.

Detailed operations of the wiper blades 411K-411LM will be explained with reference to FIGS. 5A and 5B.

Figure 5A:
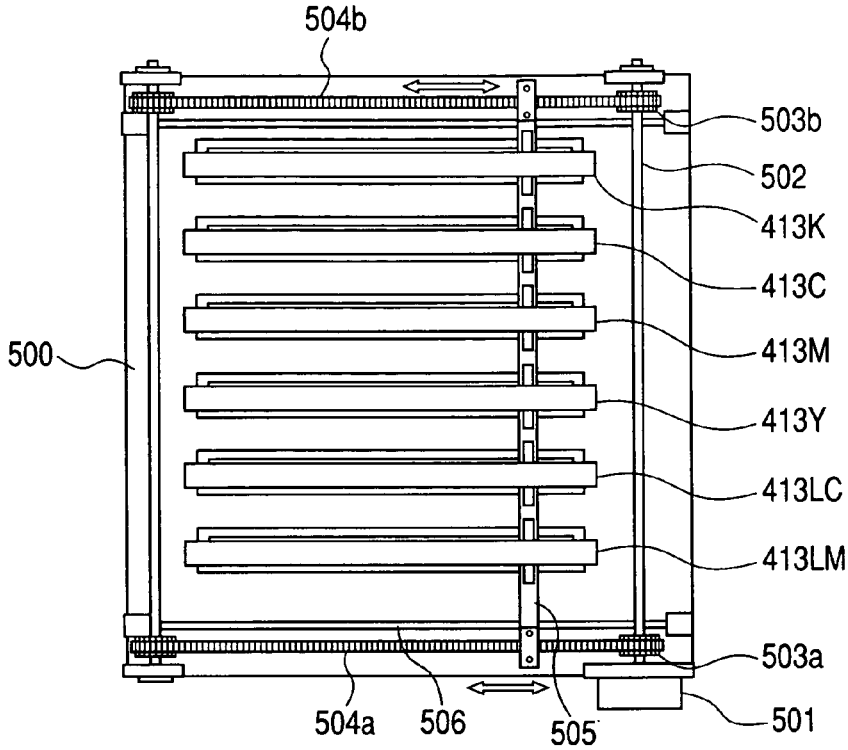
FIGS. 5A and 5B are schematic views showing details of a wiping operation in a recording module of 4-color structure.
Figure 5B:
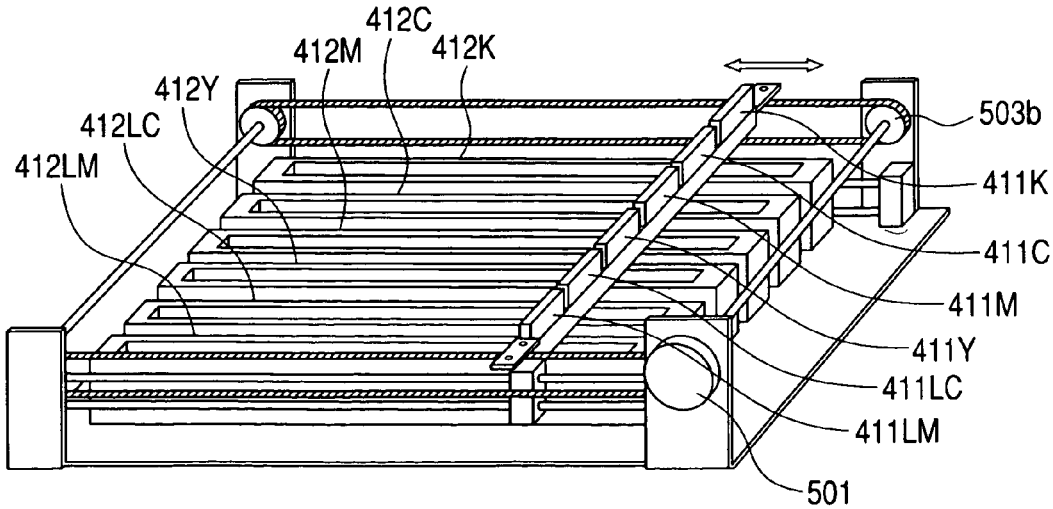

FIG. 5A is a plan view of the recording module seen from above, and FIG. 5B is a perspective view, seen from diagonally above, of the capping mechanisms 412K-412LM and the wiper blades 411K-411LM, omitting the recording heads.

On a support plate 500 for the entire capping mechanisms, a wiping motor 501 is provided for causing a sliding motion of a wiper blade holder 505 in a lateral direction through driving pulleys 503*a*, 503*b* coupled with the motor shaft and driving belts 504*a*, 504*b*, thereby wiping the nozzle faces of the recording heads 413K-413LM respectively with the wiper blades 411K-411LM.

A guide shaft 506 is provided for guiding the movement of the wiper blade holder 505.

FIGS. 6A to 6D illustrate transitions of physical states of the recording modules.

Figures 6A, 6B, 6C, 6D:
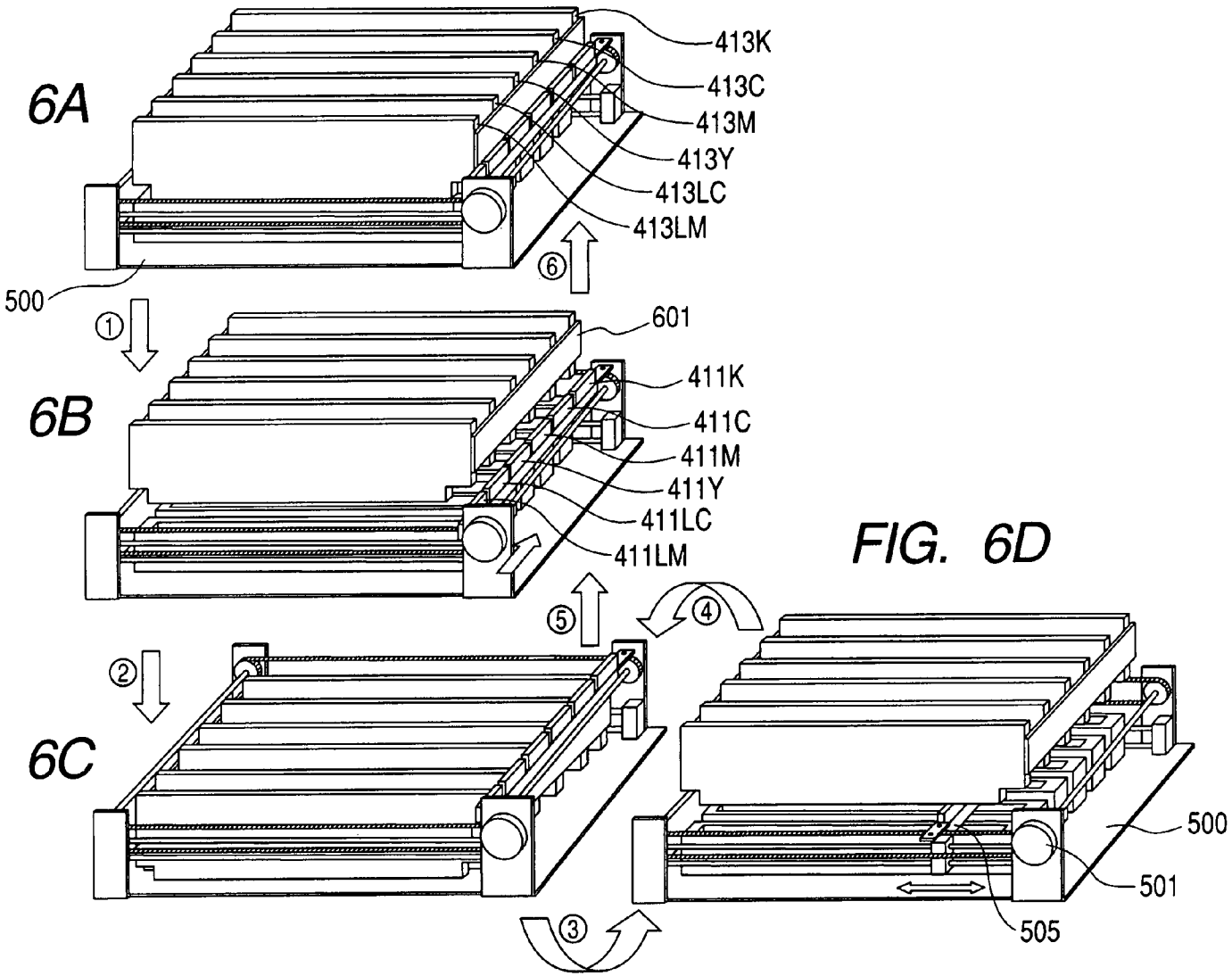
FIGS. 6A, 6B, 6C and 6D are schematic views showing state transitions in the recording module.

FIG. 6A shows a stand-by state in which the recording head is closed by capping, and, in response to a recording operation command, the state shifts as indicated by an arrow (1) to FIG. 6B.

At first the recording heads 413K-413LM move upward slightly as indicated in (1) by an unillustrated head up/down (U/D) motor, and then the capping mechanism support plate 500 moves horizontally in a direction indicated by an arrow, by an unillustrated capping motor. In this operation, the wiper blades 411K-411LM move integrally with the capping mechanism.

Then the state shifts as indicated by an arrow (2) wherein the recording heads 413K-413LM are lowered toward the recording medium and stop at a recording position (FIG. 6C).

A head holder 601 is coupled with and physically support the recording heads 413K-413LM.

Then, a recording operation is executed and when a cleaning request is issued for the nozzle area of the recording heads 413K-413LM, the state shifts as indicated by an arrow (3) whereupon the recording heads 413K-413LM once interrupt the recording operation and are elevated to a cleaning position by the wiper blades 411K-411LM, and then the wiping motor 501 is activated to wipe off ink drops accumulated on the nozzle faces in the lower part of all the recording heads 413K-413LM (FIG. 6D).

Upon completion of the cleaning operation, the state shifts as indicated by an arrow (4) to the recording position thereby re-starting the recording operation. Thereafter, the state shifts indicated by arrows (3) and (4) are repeated until all the recording operation is completed.

Upon completion of all the recording operation, the state shifts in the order of (5) and (6) whereby the recording heads 413K-413LM return to the stand-by capped state (FIG. 6A).

Relative movement of the capping mechanism support plate 500, supporting the capping mechanisms 412K-412LM and the recording heads 413K-413LM will be explained with reference to FIGS. 7A and 7B. The capping mechanism support plate 500 is provided with penetrating apertures 700 which are to be passed by the lower nozzle faces of the recording heads 413K-413LM for reaching a recording position slightly above the surface of the recording medium (FIG. 7B).

Figures 7A, 7B:
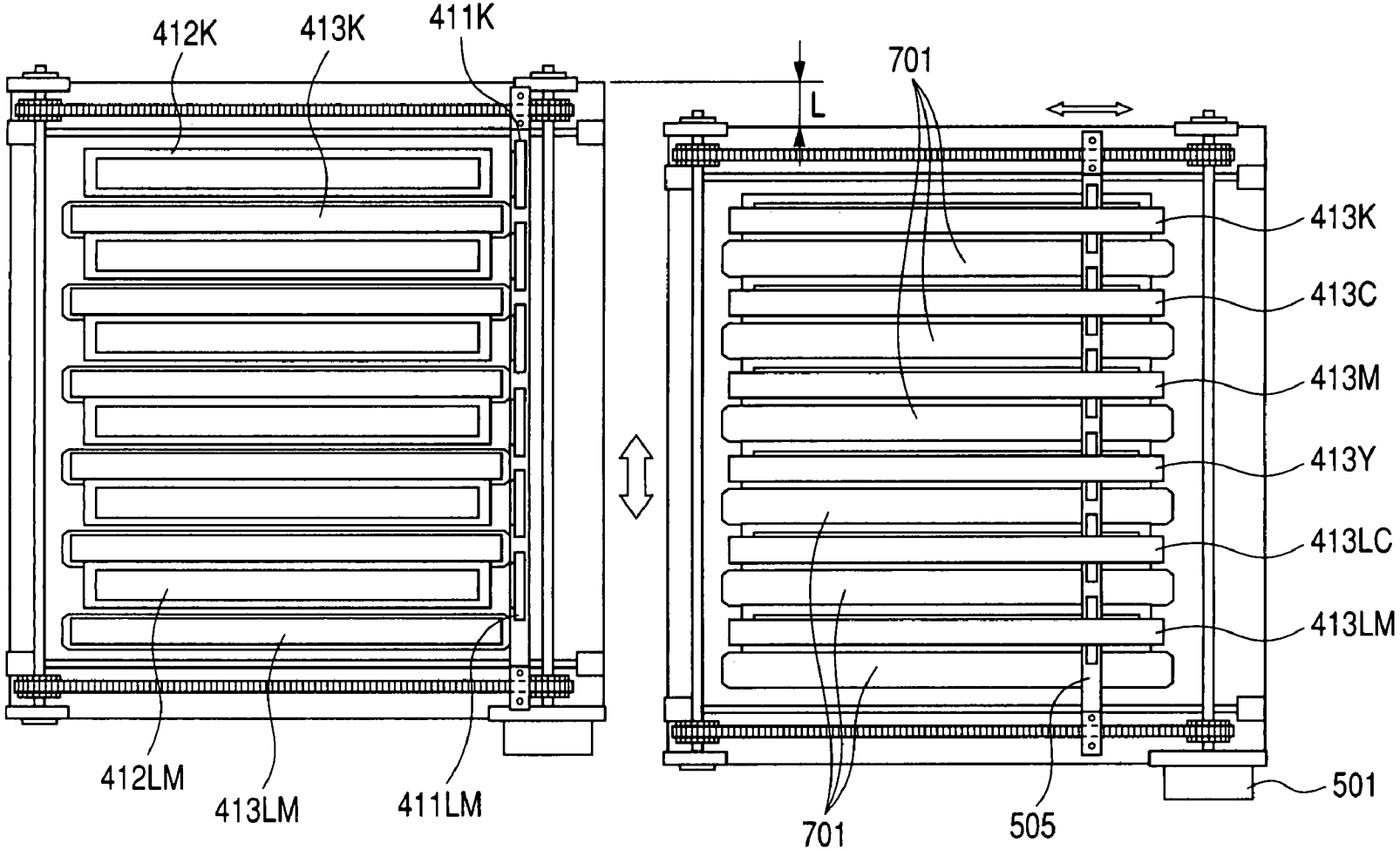
FIG. 7A and 7B are views showing a relative positional relationship between a recording head and a capping mechanism.

FIG. 7B shows a state where the wiper blade holder 505 simultaneously wipes the nozzle faces of the recording heads 413K-413LM by the function of the wiping motor 501. In this state, the relative positional relationship of the recording heads 413K-413LM and the capping mechanisms 412K-412LM seen from above is same as that in the stand-by (capped) state.

Upon completion of the ink wiping operation on the nozzle faces by the wiper blades 411K-411LM, the capping mechanism support plate 500 including the wiper blade holder 505 is displaced horizontally by a distance L, whereby the comb tooth-shaped apertures 701 coincide in the horizontal position with the recording heads 413K-413LM, and, in such state, the recording heads 413K-413LM are lowered as shown in FIG. 7A to complete a positioning operation for the recording operation.

FIG. 7A corresponds to FIG. 6A already explained, and FIG. 7B corresponds to FIG. 6B.

Figure 8:
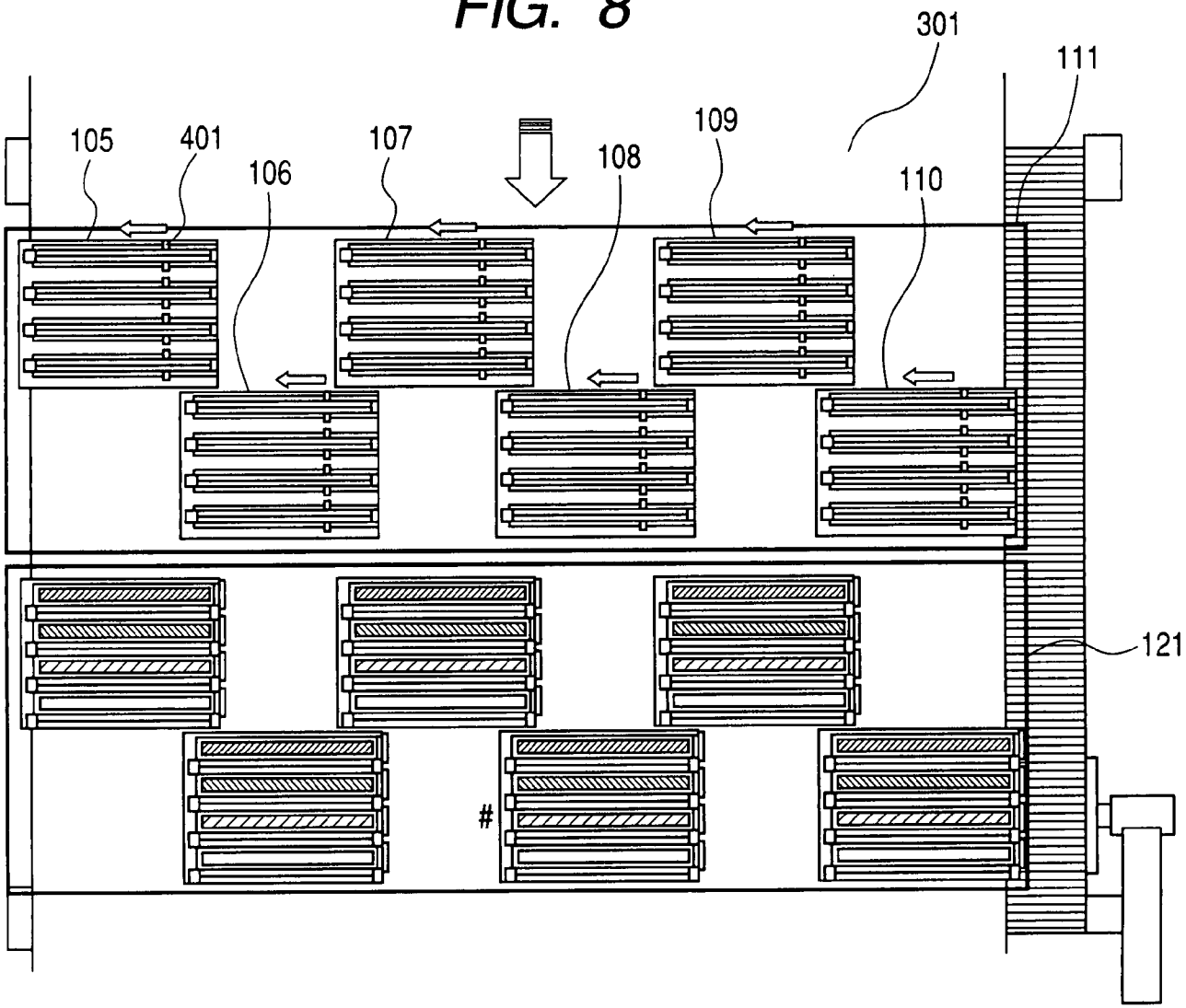
FIG. 8 is a schematic view showing a state of a cleaning operation of a recording unit 1.

FIG. 8 schematically shows a state where the recording unit 111, in the upstream side in the recording medium conveying direction, enters a cleaning operation, and where a complete image is formed only by the recording unit 121 at the downstream side.

The wiper blades 401 for the recording modules 105-110 are activated simultaneously, but they need not be completely synchronized. As the wiping operation of the nozzle face of the recording head by the wiper blade is executed in a space above the recording medium 301, the elastic wiper blades 411K-411LM preferably execute the wiping operation in the longitudinal direction as shown in the drawing, in order that the wiped-off ink drops do not scatter. The wiper blades 411K-411LM are squeezed in advance by an unillustrated blade squeezing mechanism. It is also important to execute deceleration and stopping smoothly after the wiping operation, and the wiping motor 501 is preferably constituted of a DC servo motor under a feedback control.

Figure 9:
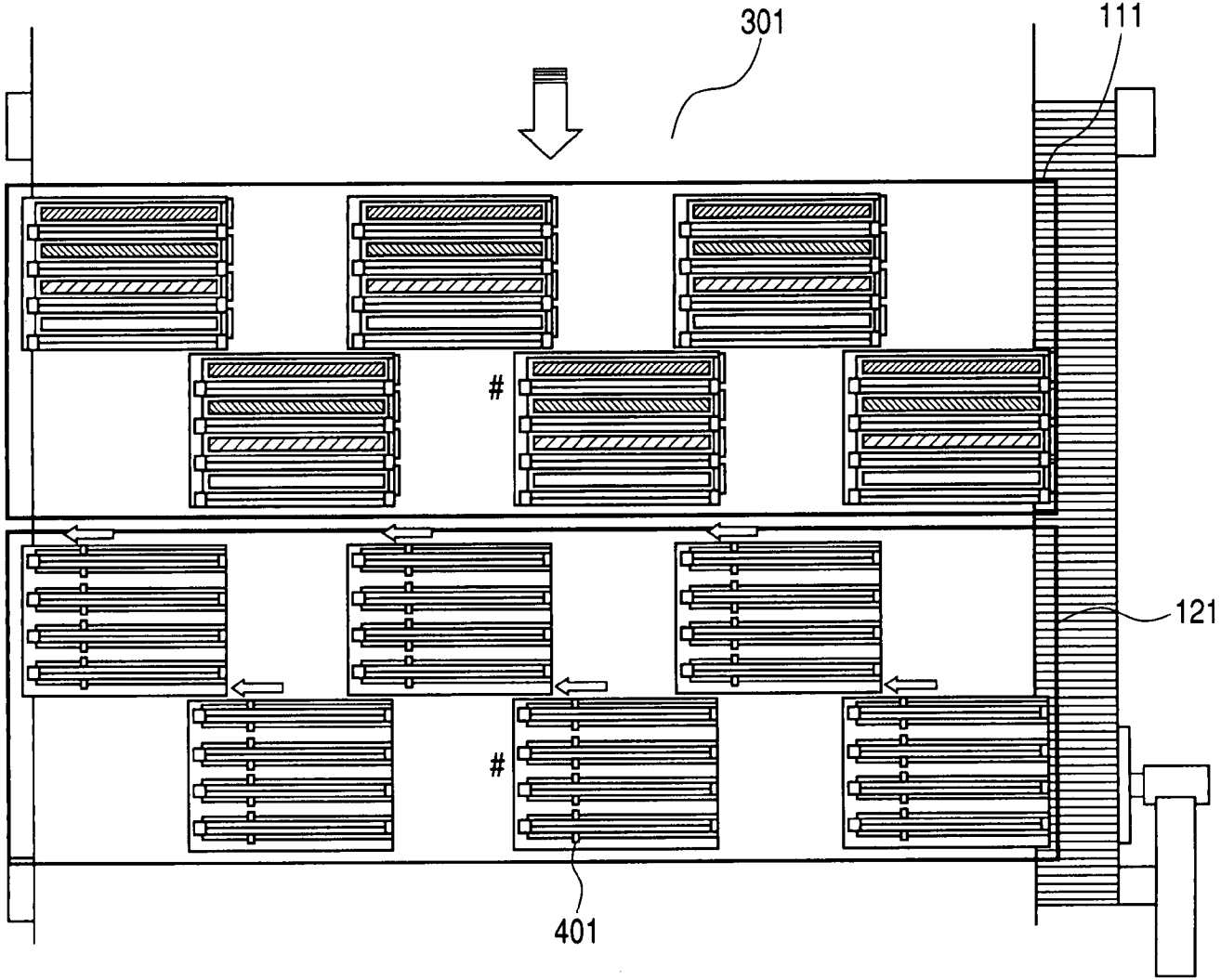
FIG. 9 is a schematic view showing a state of a cleaning operation of a recording unit 2.

FIG. 9 schematically shows a state where the recording unit 121, in the downstream side in the recording medium conveying direction, enters a cleaning operation, and where a complete image is formed only by the recording unit 111 at the upstream side.

In the states shown in FIGS. 8 and 9, the recording speed (conveying speed of the recording medium 301) is limited to about ½ of that in the state shown in FIG. 3, where both recording units 111, 121 share the recording.

The present embodiment is being explained by a case of executing 6-color recording, but, in an application of employing inks of a same color in all the recording heads of all the recording modules, it is possible, by causing each recording head to execute recording spaced for example by every six raster lines, to obtain a recording speed (conveying speed of the recording medium 301) of 6 times at maximum.

Figure 10:
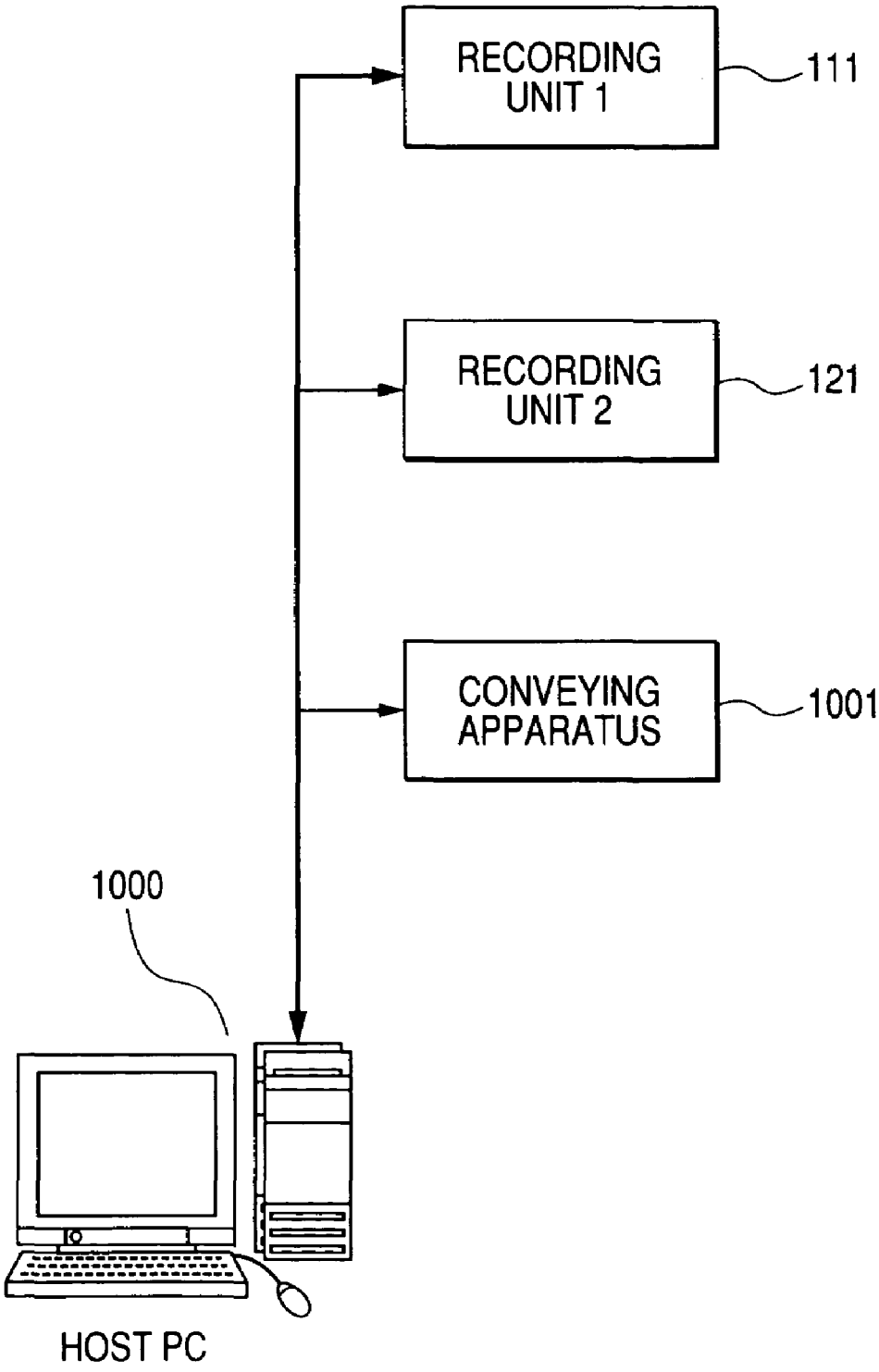
FIG. 10 is a view showing a connection state of a host PC, a conveying apparatus and recording units 1, 2.

FIG. 10 shows a connection state of a host PC 1000 for preparing and transferring image data and issuing a recording operation start command, a recording unit 1 (111), a recording unit 2 (121) and a conveying apparatus 1001. For example a USB interface is used for the connection.

Figure 11:
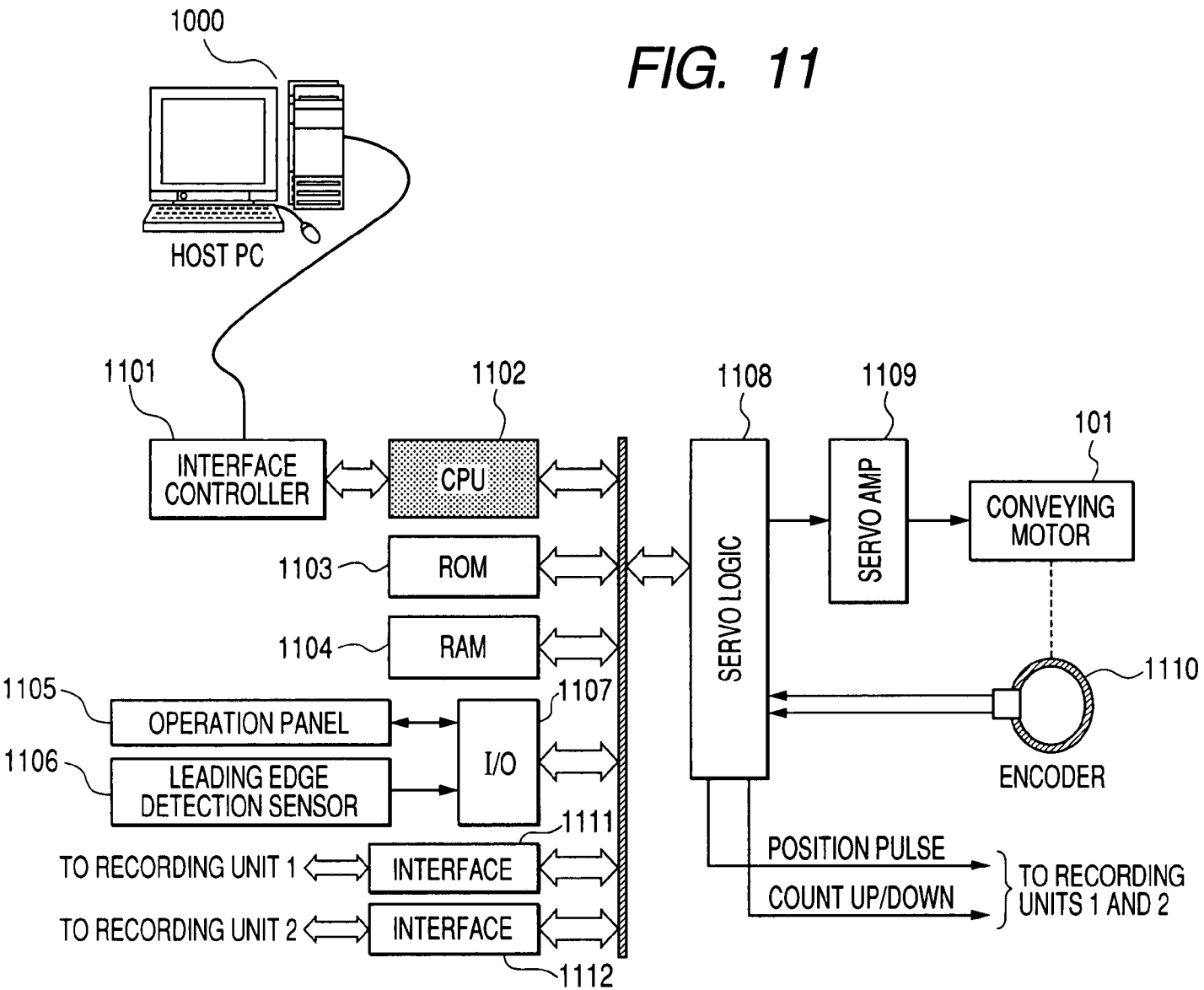
FIG. 11 is an electrical block diagram of a conveying apparatus.

FIG. 11 is an electrical block diagram of the conveying apparatus 1001 for handling the recording medium 301.

A command for starting or stopping the conveying of the recording medium 301 is received from the host PC 1000 through a USB interface controller, and a CPU 1102 analyzes the command.

Upon receiving a conveying start command, a conveying speed instruction etc. are written into a servo logic 1108 for instructing a start of operation. Then the conveying motor 101 is activated through a servo amplifier 1109 to enter a constant-speed conveying control at an instructed speed, for example 400 mm/sec.

The speed control is executed by the servo logic 1108 itself, by feeding back an output of a rotary encoder 1110, coupled to the rotary shaft of the conveying motor 101, to the servo logic 1108.

Thereafter, when a recording medium 301 reaches the conveying part from an unillustrated roll paper supply part and a front end is detected by a sheet front end sensor 1106, the servo logic starts to emit a count-up signal and a position pulse signal. The count up/down signal and the position pulse signal are formed by converting and synchronizing the output of the encoder 1110, and the position pulse signal is outputted, at a same rate as the resolution of the recording head, by 600 pulses when the recording medium 301 proceeds by 1 inch. The count up/down signal assumes a high level while the recording medium 301 is conveyed in the forward normal direction, and a low level during a back feed in the reverse direction. The count-up signal and the position pulse signal are also used for real-time raster cut-out for the recording units 1 and 2.

An operation panel 1105 is equipped with a display such as an LCD and various operations keys and is used for manual power on/off, start/stop of operations and monitoring of the operation status of the apparatus.

Interfaces 1111, 1112 are communication interfaces with recording units, and executes transmission/reception of the respective statuses and an automatic switching of the recording speed (conveying speed).

As the recording medium 301 is large-sized, there may also be employed sheet suction means (not shown).

Figure 12:
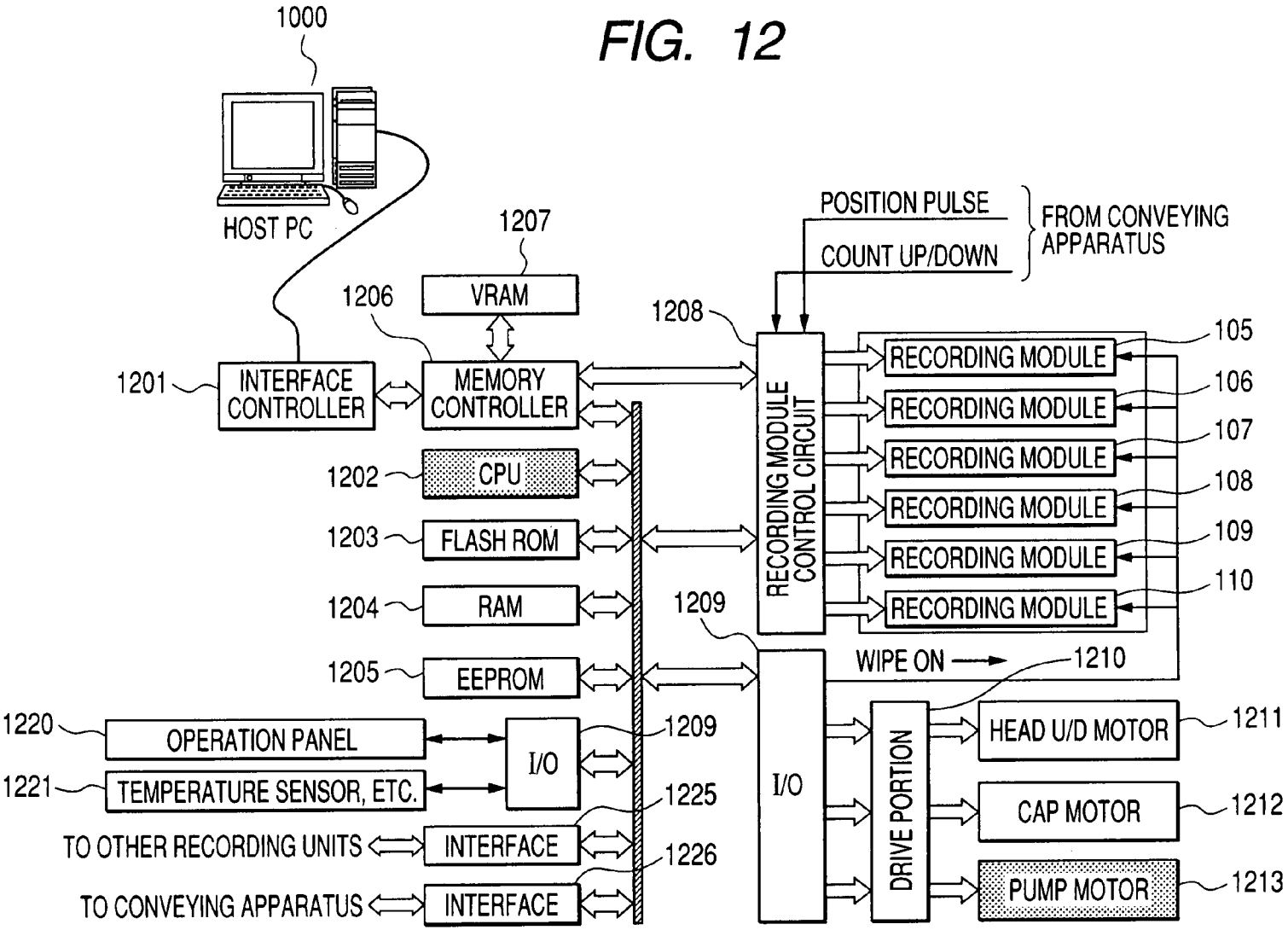
FIG. 12 is an electrical block diagram of a recording unit.

FIG. 12 is an electrical block diagram of the recording units 111, 121. As both recording units can be realized with a basically same hardware structure, the block diagram is assumed to representatively show the structure of the recording unit 1 (111).

Image recording data and a command for starting/stopping recording are received from the host PC 1000 for example through the USB interface controller 1201, and the CPU 1202 analyzes the command. The recording data received by the recording units 1, 2 are basically same full image data.

When a recording operation start command is received, recording data are written, under an instruction of the CPU 1202, at a high speed into a VRAM 1207 through the interface controller 1201 and a memory controller 1206. The recording system of the present invention is capable of continuous recording of a continuously varying image, and an amount of the recording data transferred from the host PC is always larger than an amount of recording data, recorded in a unit time by the recording unit.

Execution programs and various conversion tables for the CPU 1202 are stored in a ROM 1203. Also a RAM 1204 is used as a work memory. Information specific to the recording unit, such as information of all the recording heads in the recording modules 105-110, and slight vertical and lateral adjustment data in the recording position (registration data), is stored in a non-volatile EEPROM 1205.

Upon reception of recording data of a predetermined amount, the head up/down motor 1211 and the capping motor 1212 are activated through a driving part 1210 to shift the recording head from the stand-by state to the recording position as explained in the foregoing, thereby preparing for a recording operation. A pump motor 1213 is used for supplying the recording heads with ink from an unillustrated ink tank, and also for driving an unillustrated pressurizing pump, which, when the recording head is not used over a predetermined period, pressurizes the ink in the recording head thereby forcibly expelling the ink from the nozzles and restoring the proper recording performance.

When the count-up signal and the position pulse signal start to be received from the conveying apparatus, a current position of the recording medium is indicated by an up/down counter provided in a recording module control circuit 1208. When the recording medium reaches the recording start position of each recording module, the recording data are transferred at a high speed from the VRAM 1207, through the memory controller 1206 and the recording module recording circuit 1208, to the recording modules 105-110. The VRAM 1207 has a FIFO (first-in-first-out) structure and is refreshed to new reception data in succession from the area of already recorded data.

When both recording units 111, 121 share the recording operation, by causing the recording unit 111 to record for example odd-numbered rasters (null data being transferred for the even-numbered rasters) and by causing the other recording unit 121 to fill in the even-numbered rasters, a twice recording speed (conveying speed) can be realized in comparison with a case where only one recording head is active and the other recording head is in a cleaning operation.

An operation panel 1220 is provided with operation keys for example for power on/off and for forced stop. A temperature sensor 1221 is provided in the recording unit, but other unillustrated sensors are also provided in the recording module. An input/output port 1209 is used for identifying inputs from sensors and operation keys, and outputting an instruction for a wiping operation to the recording module.

Interfaces 1225, 1226 are used for communication with the other recording unit 121 and with the conveying apparatus 1001, particularly for confirming mutual statuses in order that a recovery operation (cleaning operation) does not overlap with that of the other recording unit 121.

A wipe-on signal is an operation instruction signal for the wiping motors 501 provided in the recording modules 105-

110, and, in the present embodiment, the wiping operations in all the recording modules 105-110 are executed at the same time.

Also each of the recording modules 105-110 may be provided with a sub CPU.

Figure 13:
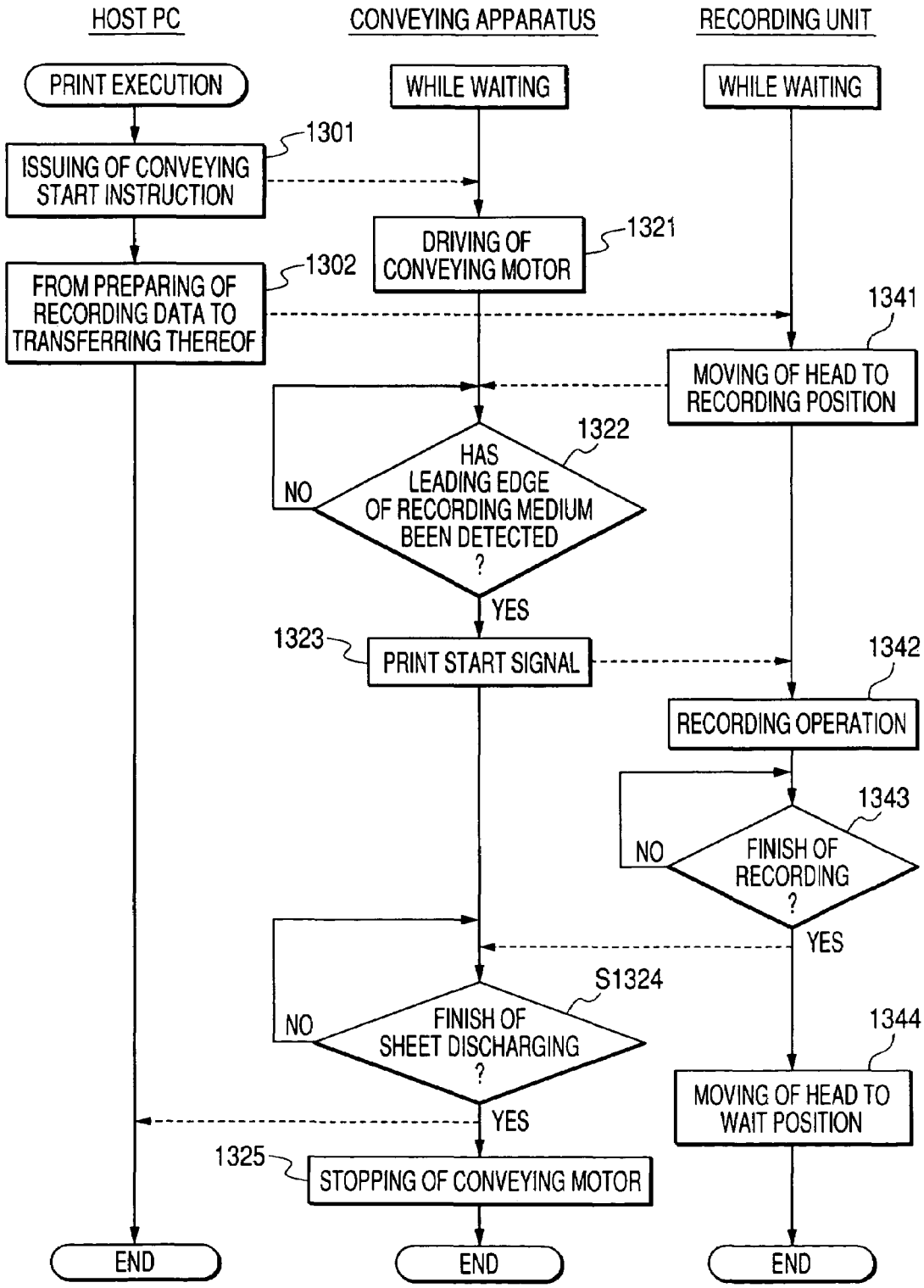
FIG. 13 is a flow chart showing mutual operations of the host PC, conveying apparatus and recording units.

Now reference is made to an operation flow chart shown in FIG. 13, for explaining the mutual operations of the host PC 1000, recording units 111, 121 and the conveying apparatus 1001.

When a start of printing is instructed on an image display of the host PC 1000, a conveying start command is issued (1301) to activate the conveying motor in the conveying apparatus (1321).

Then the recording data are prepared and transferred (1302), and each recording unit shifts the recording heads from the stand-by (capped) position to the recording position (1341).

Then, in the conveying apparatus, when the front end of the recording medium 301 is detected by the front end sensor 1106 (1322-YES), the print start signals (count-up signal and position pulse signal) start to be released (1323) to initiate the recording operation by the recording units (1342).

When the desired recording operation is completed (1343-YES), the recording heads return again to the stand-by position (1344), and, when the recording medium 301 is discharged (1324-YES), the conveying apparatus informs the host PC of completion of operation and stops the conveying motor (1325), whereupon the sequence is terminated.

In the following, mutual operation flow of the conveying apparatus and the recording units, in case a cleaning operation for the recording unit 1 is executed in the course of a recording operation, will be explained with reference to FIGS. 14A and 14B.

In the beginning, a high-speed recording operation is executed (1401) by the recording unit 1 (111) for the odd-numbered rasters (1421) and by the recording unit 2 (121) for the even-numbered rasters (1441), with a conveying speed of the conveying apparatus for example of 400 mm/sec.

When the recording operation proceeds and enters a predetermined condition for cleaning (for example a lapse of 1 minute) (1422), the recording unit 1 (111), in order to inform that the recording is to be soon interrupted, transmits an interrupting raster point (raster number) to the recording unit 2 (121) and the conveying apparatus 1001 (1423).

In response, the conveying apparatus starts to reduce the conveying speed to a low speed (for example 200 mm/sec) (1402).

When a position of the recording medium 301 corresponding to the interrupting raster passes under the recording head of the recording unit 1 (1424), the recording unit 1 interrupts the recording and immediately shifts to the cleaning operation (1425).

Then, when the position of the recording medium 301 corresponding to the interrupting raster reaches a position under the recording head of the recording unit 2 (121) (1442-YES), the recording unit 2 thereafter enters an all-raster recording mode (1443).

When the cleaning operation of the recording unit 1 comes to an end (1426-YES), it is informed from the recording unit 1 to the recording unit 2, which instructs the recording unit 1 of a re-start raster at which the recording is re-started (1444).

When a position of the recording medium 301 corresponding to the re-start raster reaches a position under the head of the recording unit 1 (1427-YES), the recording unit 1 thereafter re-starts the odd-numbered raster recording mode (1428).

Also when the position of the recording medium 301 corresponding to the re-start raster reaches a position under the head of the recording unit 2 (1445-YES), the recording unit 2 thereafter returns from the all-raster recording mode to the even-numbered raster recording mode (1446). The recording unit 2 informs the conveying apparatus of restoring the ordinary recording mode by both the recording units 1, 2, whereupon the conveying apparatus starts to elevate the conveying speed from 200 mm/sec to 400 mm/sec (1403), whereby the original recording mode is restored.

The above-explained procedure is similarly executed also when the recording unit 2 enters a cleaning operation.

Second Embodiment

Figures 15, 15A:
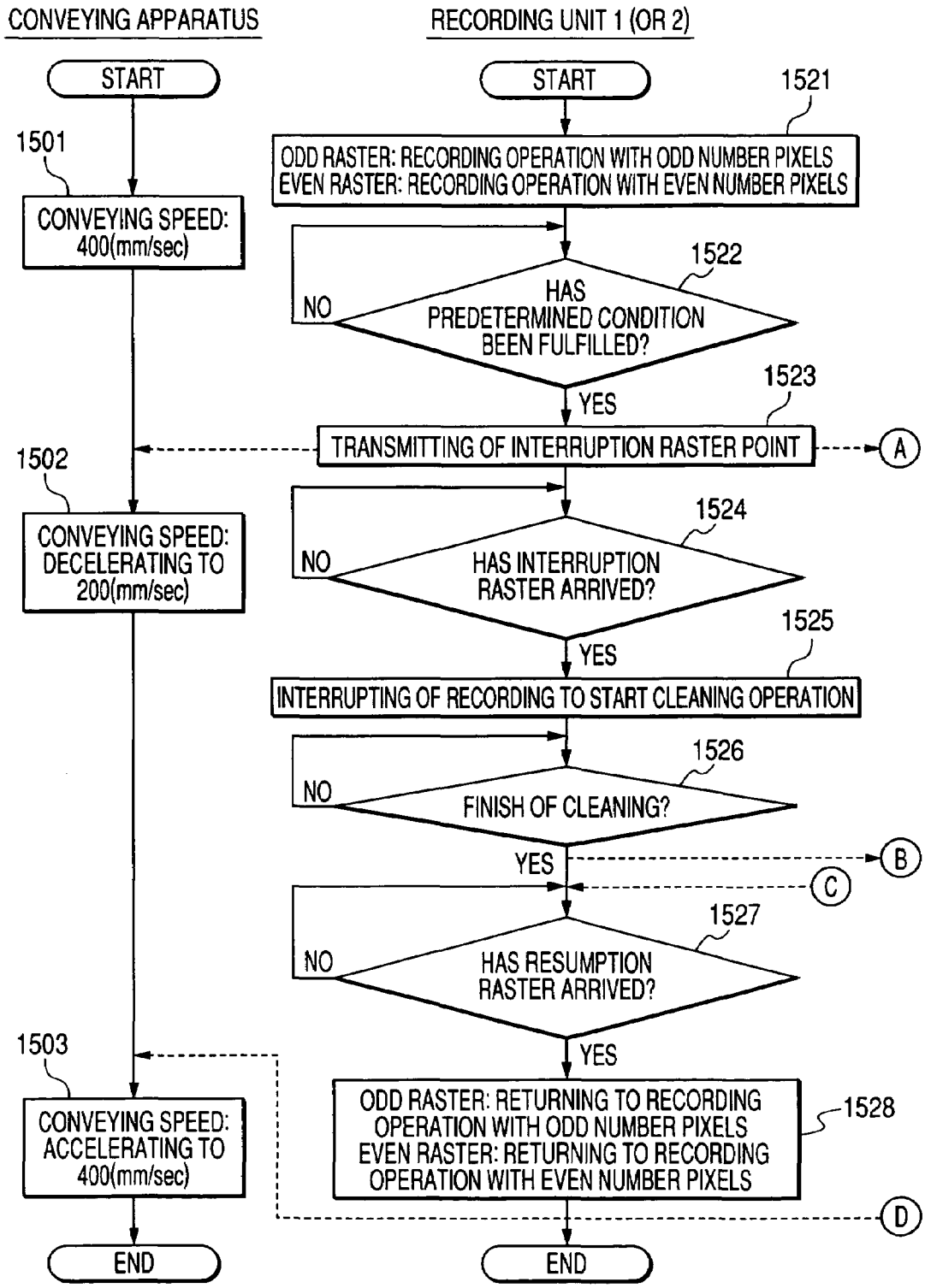
FIG. 15 comprised of FIGS. 15A and 15B illustrating flow charts of a second embodiment when a cleaning operation is executed.
Figure 15B:
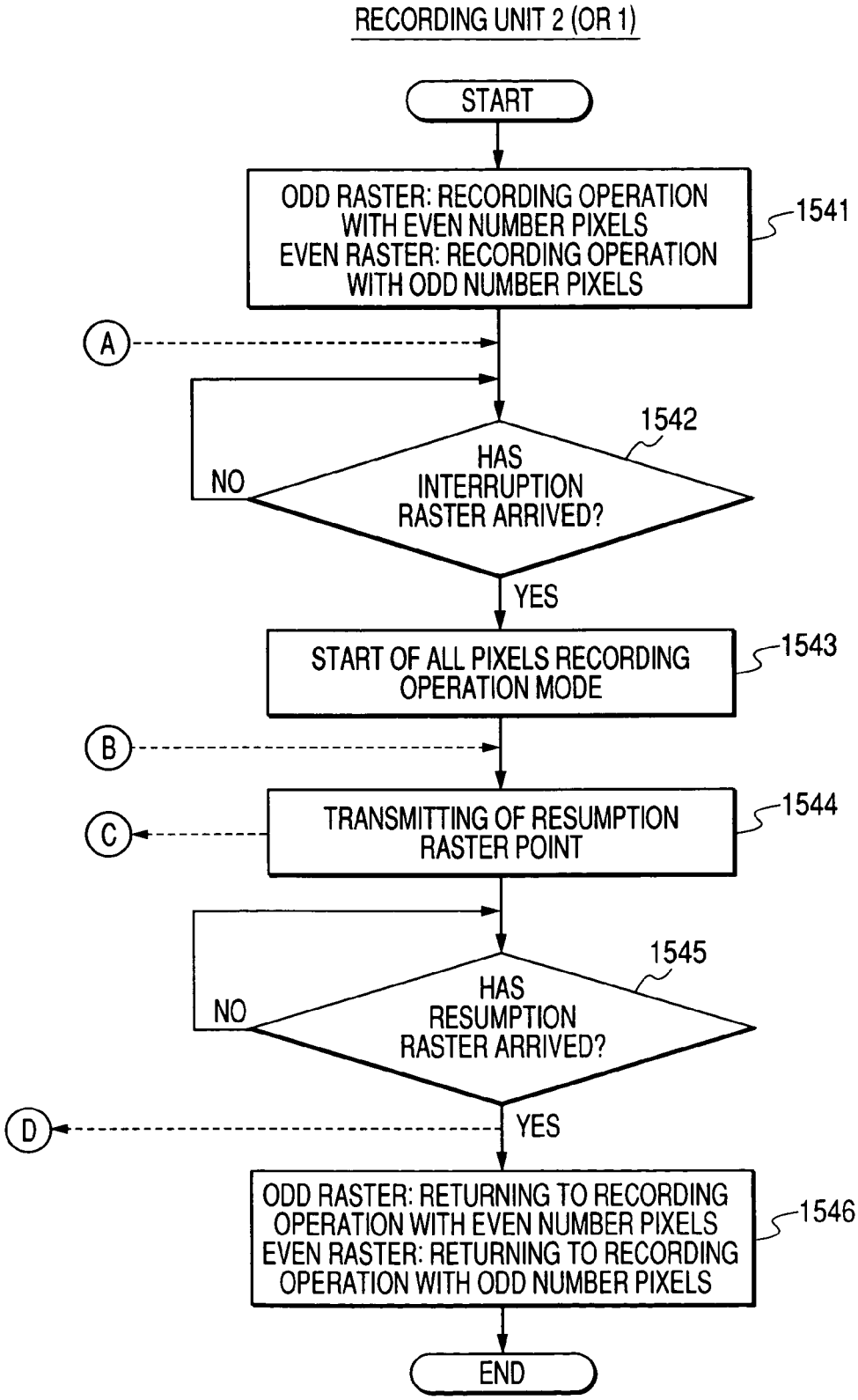

In the present embodiment, mutual operation flow of the conveying apparatus and the recording units, in case a cleaning operation for the recording unit 1 is executed in the course of a recording operation, will be explained with reference to FIG. 15.

Figures 14, 14A:
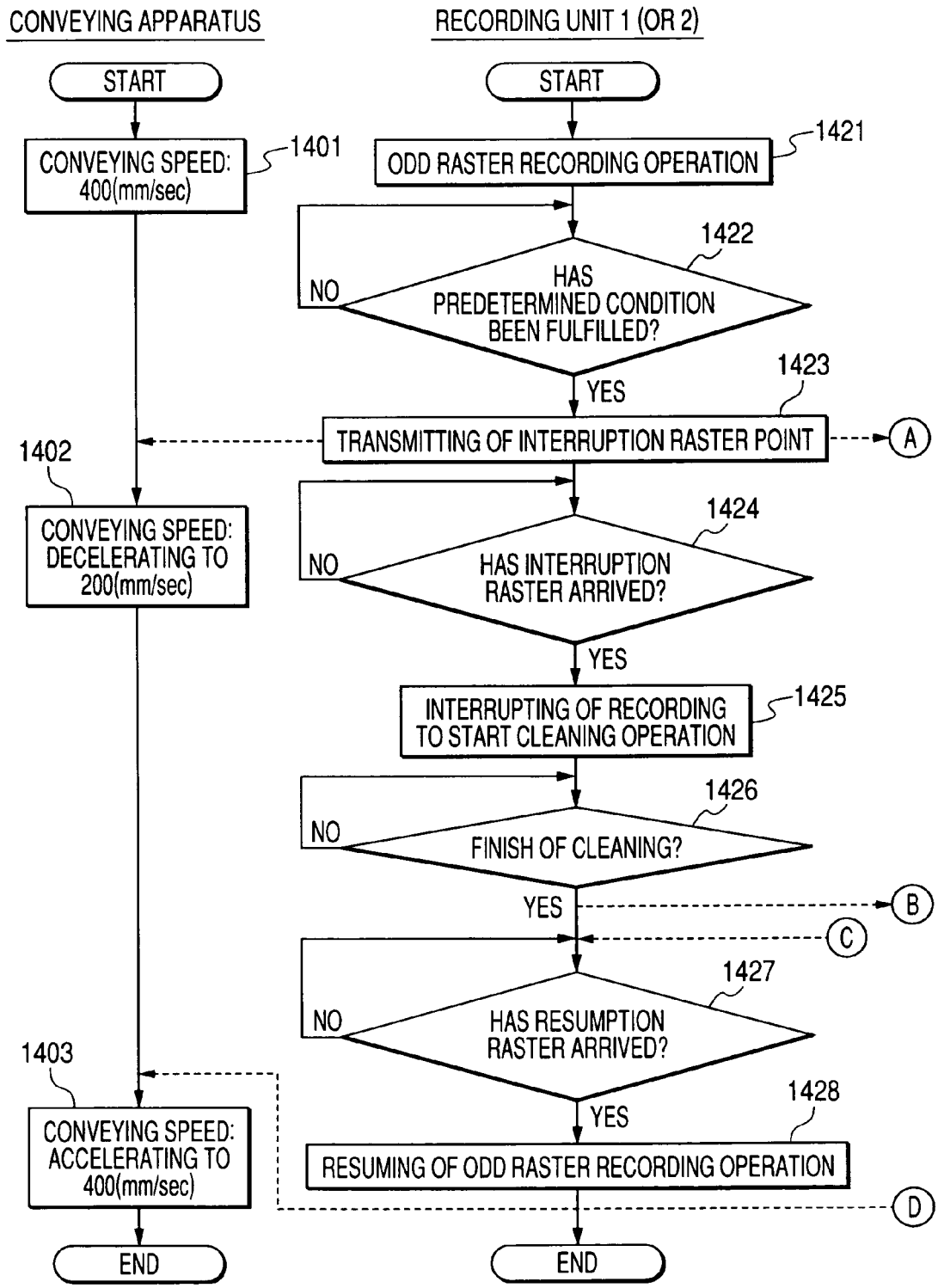
FIG. 14 comprised of FIGS. 14A and 14B illustrating flow charts showing detailed operations when a cleaning operation is executed.
Figure 14B:
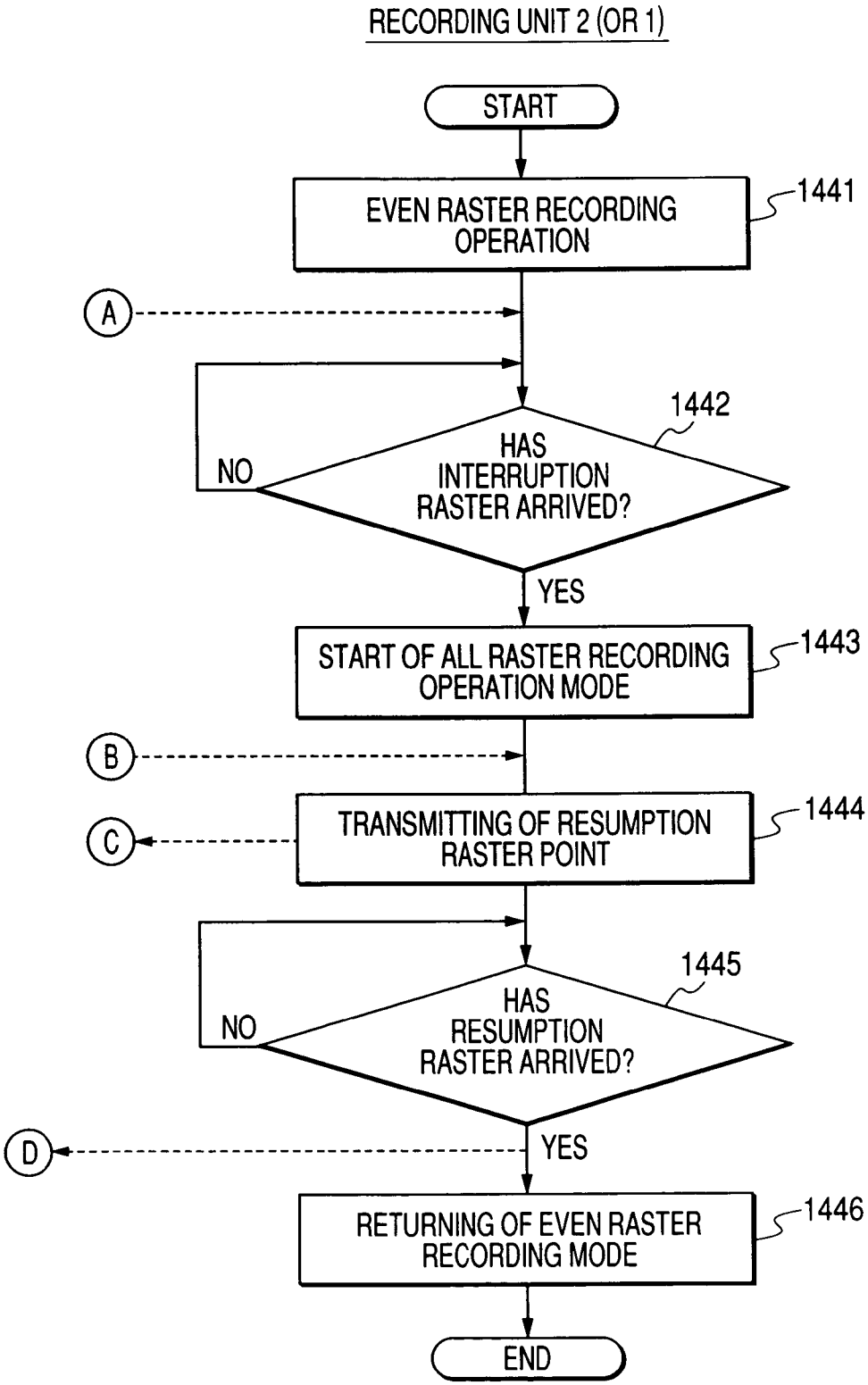

As the operation flow of the present embodiment is similar to that shown in FIGS. 14A and 14B, the explanation on a common part is partially same as explained before.

In the normal recording state of the present embodiment, the recording unit 1 (111) only records odd-numbered pixels in an odd-numbered raster, and even-numbered pixels in an even-numbered raster (1521), thus executing a skipped printing in a staggered or checkerboard pattern.

On the other hand, the recording unit 2 (121) only records even-numbered pixels in an odd-numbered raster, and odd-numbered pixels in an even-numbered raster (1521), thus complementing the pixels recorded by the recording unit 1 (1541). A high-speed recording is executed by the conveying apparatus with a conveying speed for example of 400 mm/sec (1501).

When the recording operation proceeds and enters a predetermined condition for cleaning (for example a lapse of 1 minute) (1522), the recording unit 1 (111), in order to inform that the recording is to be soon interrupted, transmits an interrupting raster point (raster number) to the recording unit 2 (121) and the conveying apparatus 1001 (1523).

In response, the conveying apparatus starts to reduce the conveying speed to a low speed (for example 200 mm/sec) (1502).

When a position of the recording medium 301 corresponding to the interrupting raster passes under the recording head of the recording unit 1 (1524-YES), the recording unit 1 interrupts the recording and immediately shifts to the cleaning operation (1525).

Then, when the position of the recording medium 301 corresponding to the interrupting raster reaches a position under the recording head of the recording unit 2 (121) (1542-YES), the recording unit 2 thereafter enters an all-pixel recording mode (1543).

When the cleaning operation of the recording unit 1 comes to an end (1526-YES), it is informed from the recording unit 1 to the recording unit 2, which instructs the recording unit 1 of a re-start raster at which the recording is re-started (1544).

When a position of the recording medium 301 corresponding to the re-start raster reaches a position under the head of the recording unit 1 (1527-YES), the recording unit 1 thereafter re-starts the recording mode of recording odd-numbered pixels in the odd-numbered raster and even-numbered pixels in the even-numbered raster (1528).

Also when the position of the recording medium 301 corresponding to the re-start raster reaches a position under the head of the recording unit 2 (1545-YES), the recording unit 2 thereafter returns from the all-pixel recording mode to the recording mode of recording even-numbered pixels in the odd-numbered raster and odd-numbered pixels in the even-numbered raster (1546).

The recording unit 2 informs the conveying apparatus of restoring the ordinary recording mode by both the recording units 1, 2, whereupon the conveying apparatus starts to elevate the conveying speed from 200 mm/sec to 400 mm/sec (1503), whereby the original recording mode is restored.

The above-explained procedure is similarly executed also when the recording unit 2 enters a cleaning operation.

As explained in the foregoing, the present invention allows, when the recording operation is once started, to avoid an interruption of the operation by the cleaning operation for the recording head, and also to attain a maximum throughput of the recording system. Also it can realize an image of an extremely high image quality, by so-called multi-path recording with plural recording heads.

As explained above, the present invention is applicable to a recording system for recording on a relatively large-sized object, such as corrugated cardboard, at a high speed, an image of an extremely high quality with a high reliability.

Third Embodiment

Figure 16:
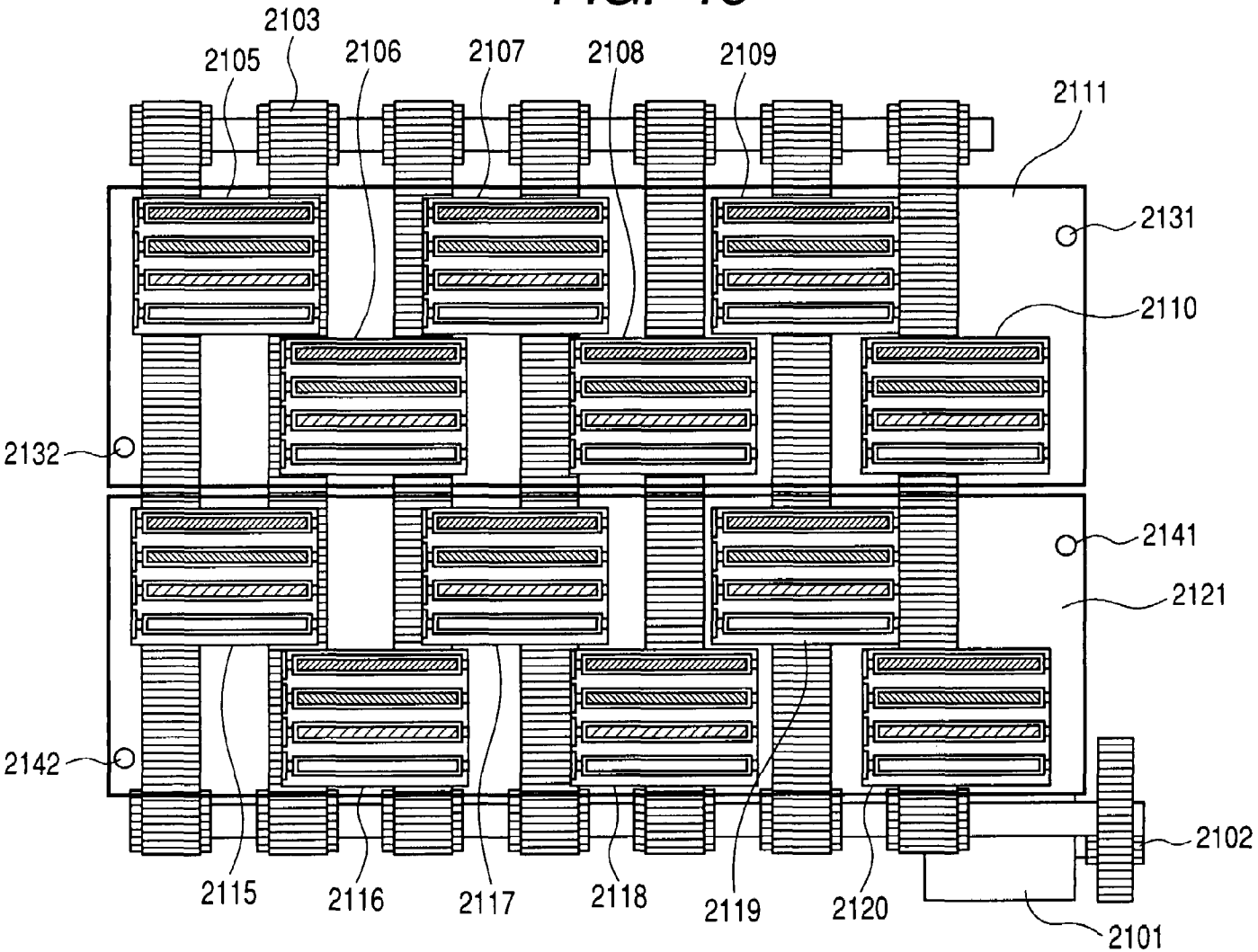
FIG. 16 is a plan view of a recording apparatus in a third embodiment of the present invention.

FIG. 16 is a schematic view showing a configuration seen from above of a recording system of the present invention.

The recording system is constituted of two recording units 2111, 2121 and a common conveying apparatus for conveying a recording medium (paper sheet), and the recording units are respectively constituted of recording modules 2105-2110 and 2115-2120, each having four line heads with 2560 nozzles at a resolution of 600 dot/inch. A maximum recording width per recording module is therefore about 4.3 inches, but an overlapping area is required as illustrated between adjacent recording modules in order to secure a continuity of image in the direction of width, and a staggered arrangement of 6 recording modules in the direction of width of the recording medium provides, in consideration of the above-mentioned overlapping areas, a rated maximum recording width of 24 inches. The recording medium is conveyed from above to below in the drawing, on plural conveying belts 2103, by a driving gear 2102 coupled with a rotary shaft and driven by a sheet conveying motor 2101, and is subjected to a high-speed image recording upon passing under the recording units 2111, 2121. For the purpose of clarity, substrates for the recording units 2111, 2121 are represented as a semi-transparent members.

Four recording heads in each recording module are for K (black), C (cyan), M (magenta) and Y (yellow) colors, but they may also be for a same color. FIG. 16 shows a stand-by state in which all the recording heads are capped by capping mechanisms, as will be explained later in more details.

The recording unit 2111 is provided with positioning pins 2131, 2132 while the recording unit 2121 is provided with positioning pins 2141, 2142, of which details will be explained later.

Figures 17A, 17B:
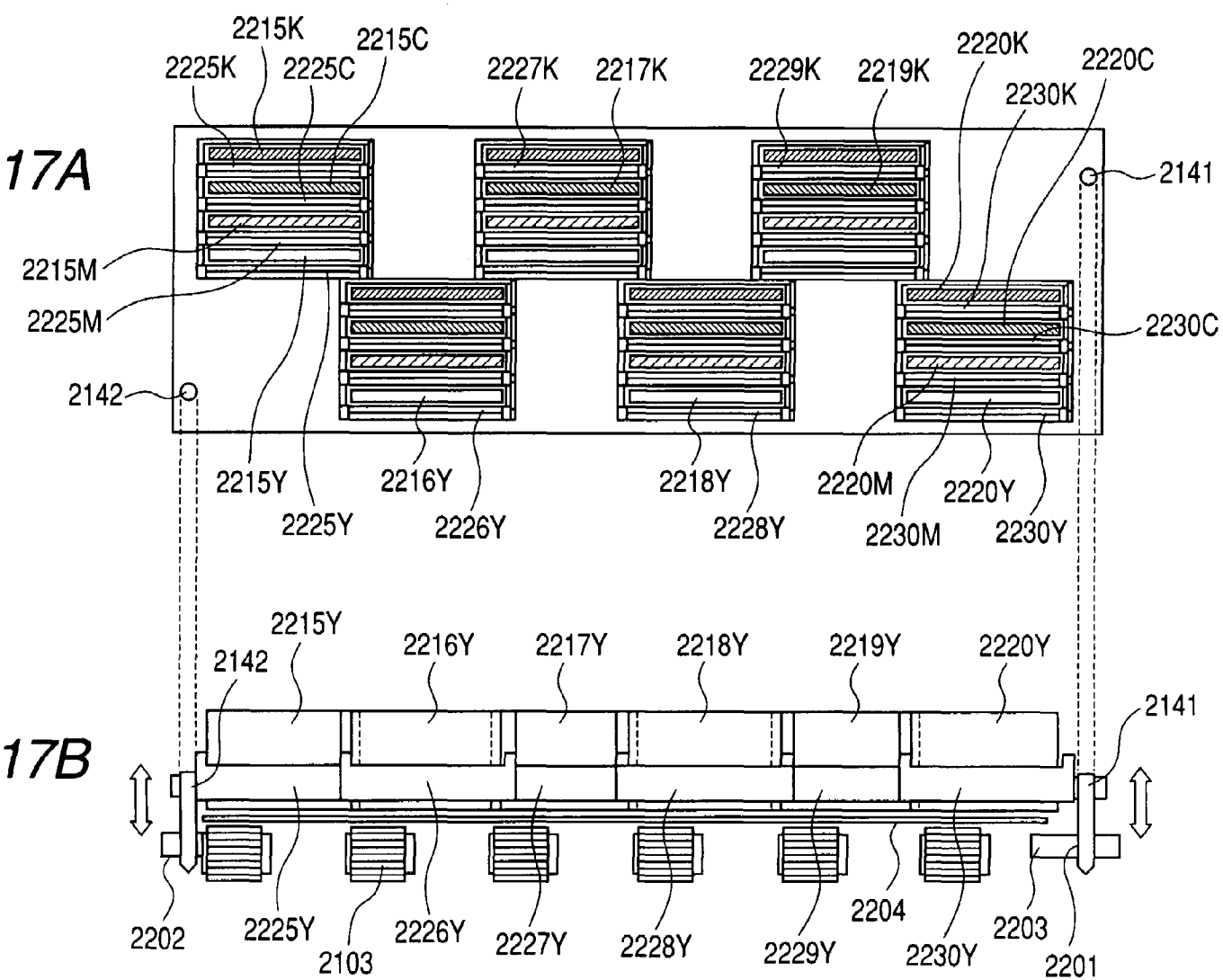
FIGS. 17A and 17B are respectively a plan view of a recording apparatus in the above-mentioned embodiment and a lateral view in a recording operation.

FIGS. 17A and 17B are respectively a plan view of the recording unit 2112 and a lateral view thereof seen from the downstream side in the conveying direction, in a state during a recording operation.

In the left-end recording module 2115, the recording heads 2215K, C, M and Y and the cleaning mechanisms 2225 K, C, M and Y, including the respective caps, are mutually displaced in comb-tooth manner, when seen from above. The recording heads 2215K, C, M and Y are movable perpendicularly to a recording surface of a sheet 2204, while the cleaning mechanisms 2225 K, C, M and Y are movable forward and backward in the conveying direction of the sheet 2204, over a range slightly larger than the thickness of a single recording head.

K, C, M and Y respectively correspond to ink colors of black, cyan, magenta and yellow.

Each recording module has following recording heads and cleaning mechanisms, with a configuration common to all the recording modules:

Recording module 2115:
recording heads 2215K-2215Y, and cleaning mechanisms 2225K-2225Y;

Recording module 2116:
recording heads 2216K-2216Y, and cleaning mechanisms 2226K-2226Y;

Recording module 2117:
recording heads 2217K-2217Y, and cleaning mechanisms 2227K-2227Y;

Recording module 2118:
recording heads 2218K-2218Y, and cleaning mechanisms 2228K-2228Y;

Recording module 2119:
recording heads 2219K-2219Y, and cleaning mechanisms 2229K-2229Y; and Recording module 2120:
recording heads 2220K-2220Y, and cleaning mechanisms 2230K-2230Y.

The aforementioned positioning pins 2141, 2142 are provided in a diagonal direction of the recording unit 2121, and, in a recording operation state shown in FIG. 17B, are positioned as guided by guide portions (penetrating holes) 2201, 2202 provided in a platen 2203, fixed under the sheet 2204 conveyed on the conveying belts 2103.

Figures 18A, 18B:
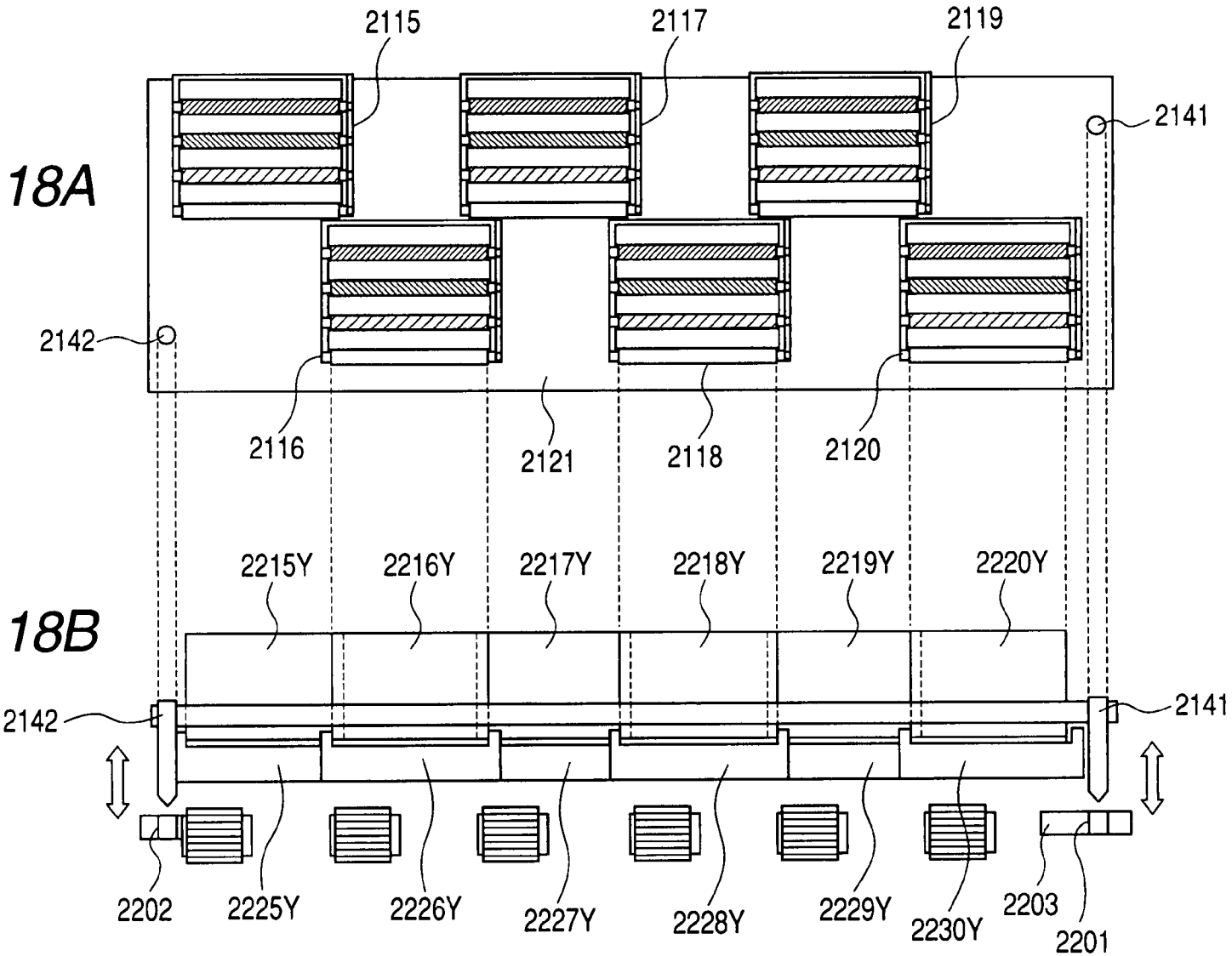
FIGS. 18A and 18B are respectively a plan view of a recording apparatus in the above-mentioned embodiment and a lateral view in a stand-by state.

Then, FIGS. 18A and 18B show a stand-by state, in which all the cleaning mechanisms 2225K, C, M, Y-2230K, C, M, Y and the recording heads 2215K, C, M, Y-2220K, C, M, Y within the recording unit coincide in the position in the conveying direction, whereby all the recording heads are capped as shown in FIG. 18B seen from the downstream side of the conveying direction.

In this state, the positioning pins 2141, 2142 are separated from the guide portions 2201, 2202 of the platen 2203, but may still maintain the guided state.

Figure 19A:
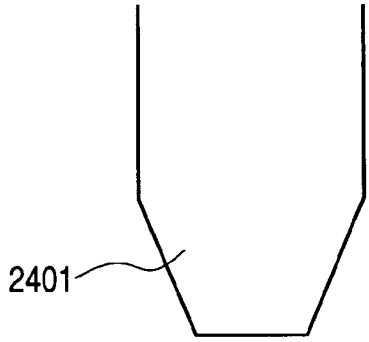
FIGS. 19A, 19B and 19C are views showing a positioning pin and a guide portion in the above-mentioned embodiment of the present invention.

Now, shapes of the positioning pins 2141, 2142 and the guide portions 2201, 2202 will be explained with reference to FIGS. 19A to 19C. The positioning pins 2141, 2142 are slightly pointed at a front end portion as indicated by 2401 in FIG. 19A, for enabling smooth guiding action. The guide portion 2201 provided in the platen 2203 has an internal diameter slightly larger than the external diameter of the positioning pin 2141, as shown in FIG. 19B. A difference between the internal diameter of the guide portion 2201 and the external diameter of the positioning pin is selected, in case the recording head has a resolution for example of 600 dpi (dot/inch), as about 20 μm (about a half of a dot) or less.

Figure 19C:
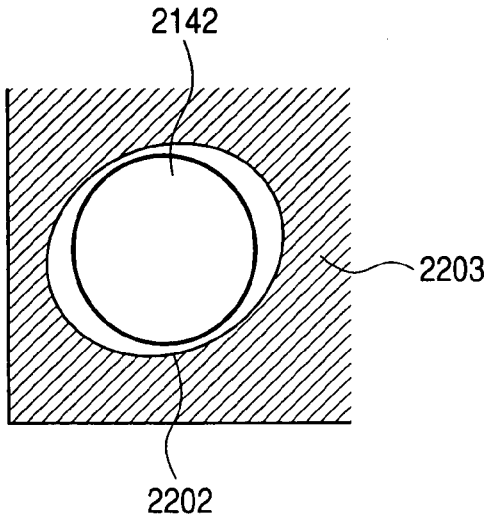
Figure 19B:
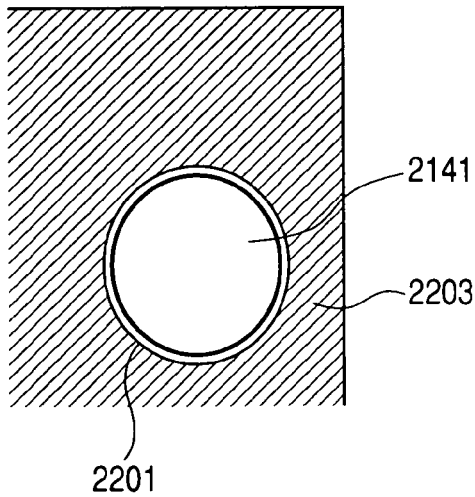
Figure 20:
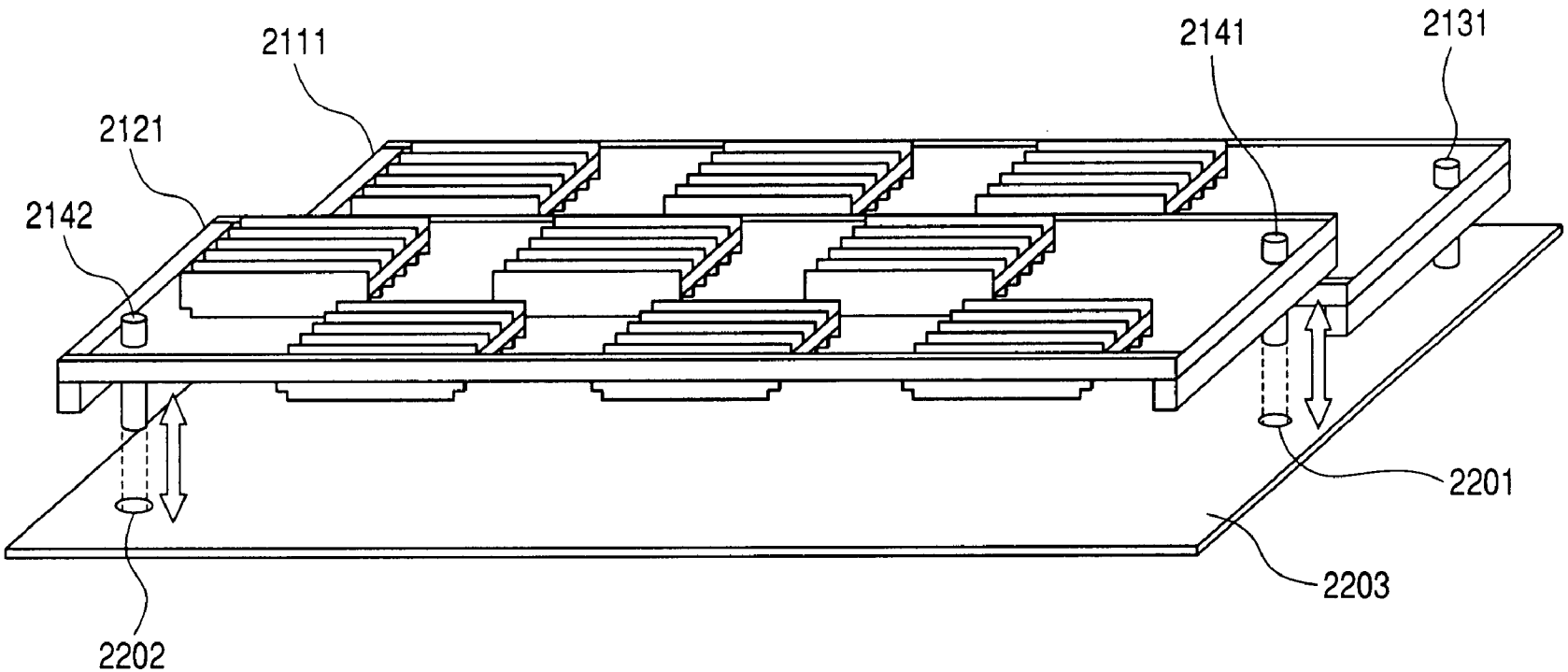
FIG. 20 is a schematic view showing an up-down motion of the recording unit.

The guide portion 2202 for the other positioning pin 2142 is designed in an oval shape, elongated along the diagonal direction, as shown in FIG. 19C. Differences of internal diameters of the guide portion 2202 with respect to the external diameter of the positioning pin 2142 are somewhat varied depending on the material constituting the platen 2203 and the environmental conditions in which the recording apparatus is to be used.

Each of the recording units 2111, 2121 is independently capable of displacing all the recording heads thereof perpendicularly to the platen 2203 positioned under the sheet, so that, for example the recording unit 2121 alone can shift to the cleaning operation while the recording unit 2111 continues the recording operation in the illustrated position, and, when the recording operation is re-started, an aberration in the image recording position can be suppressed to about a half or less by means of the positioning pins 2141, 2142 and the guide portions 2201, 2202.

Figure 21:
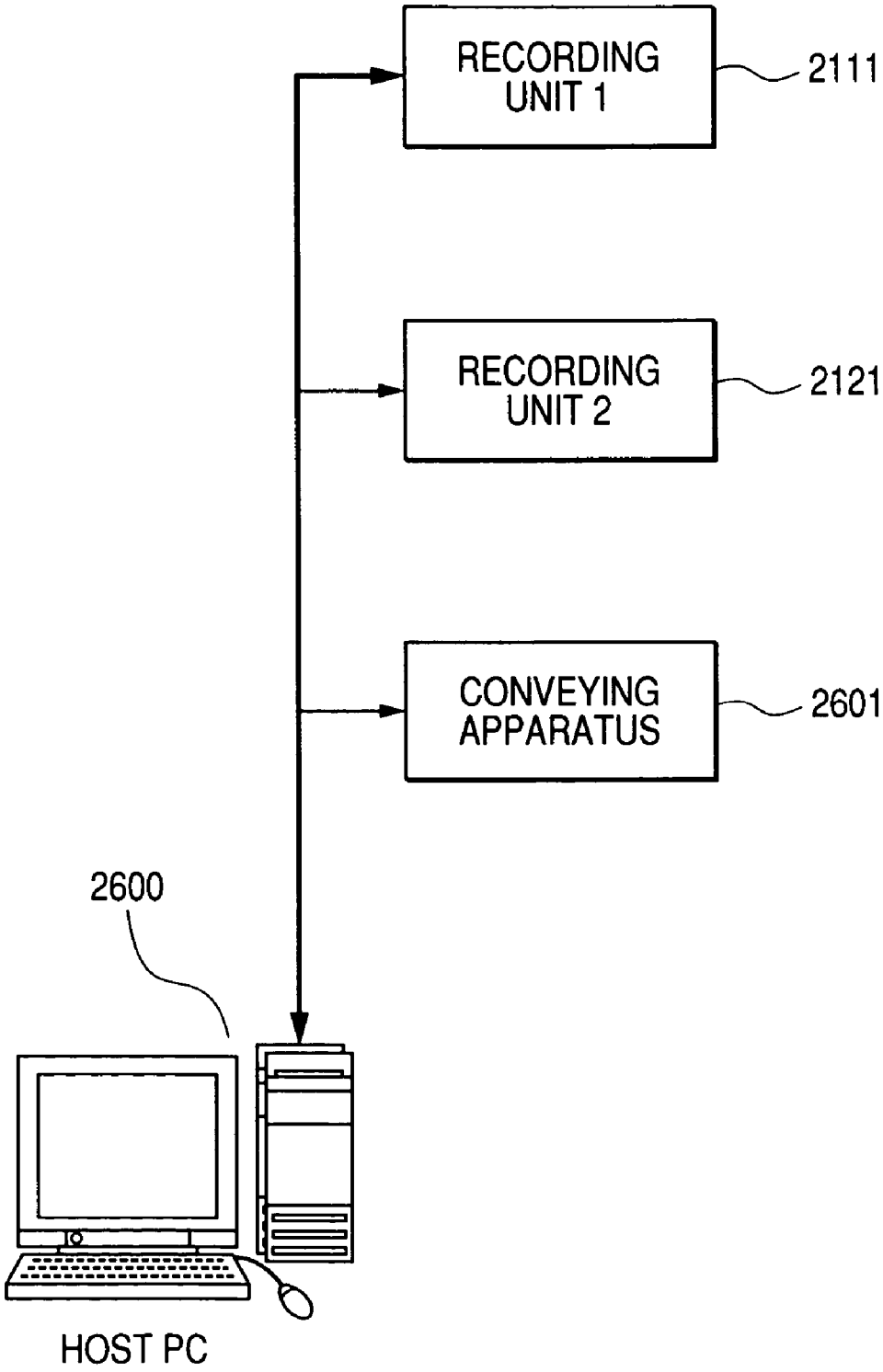
FIG. 21 is a view showing a connection state of a host PC, a recording apparatus and a conveying apparatus.

FIG. 21 shows a connection state of a host PC 2600 for preparing and transferring image data and issuing a recording operation start command, a recording unit 1 (2111), a recording unit 2 (2121) and a conveying apparatus 2601. For example a USB interface is used for the connection.

Figure 22:
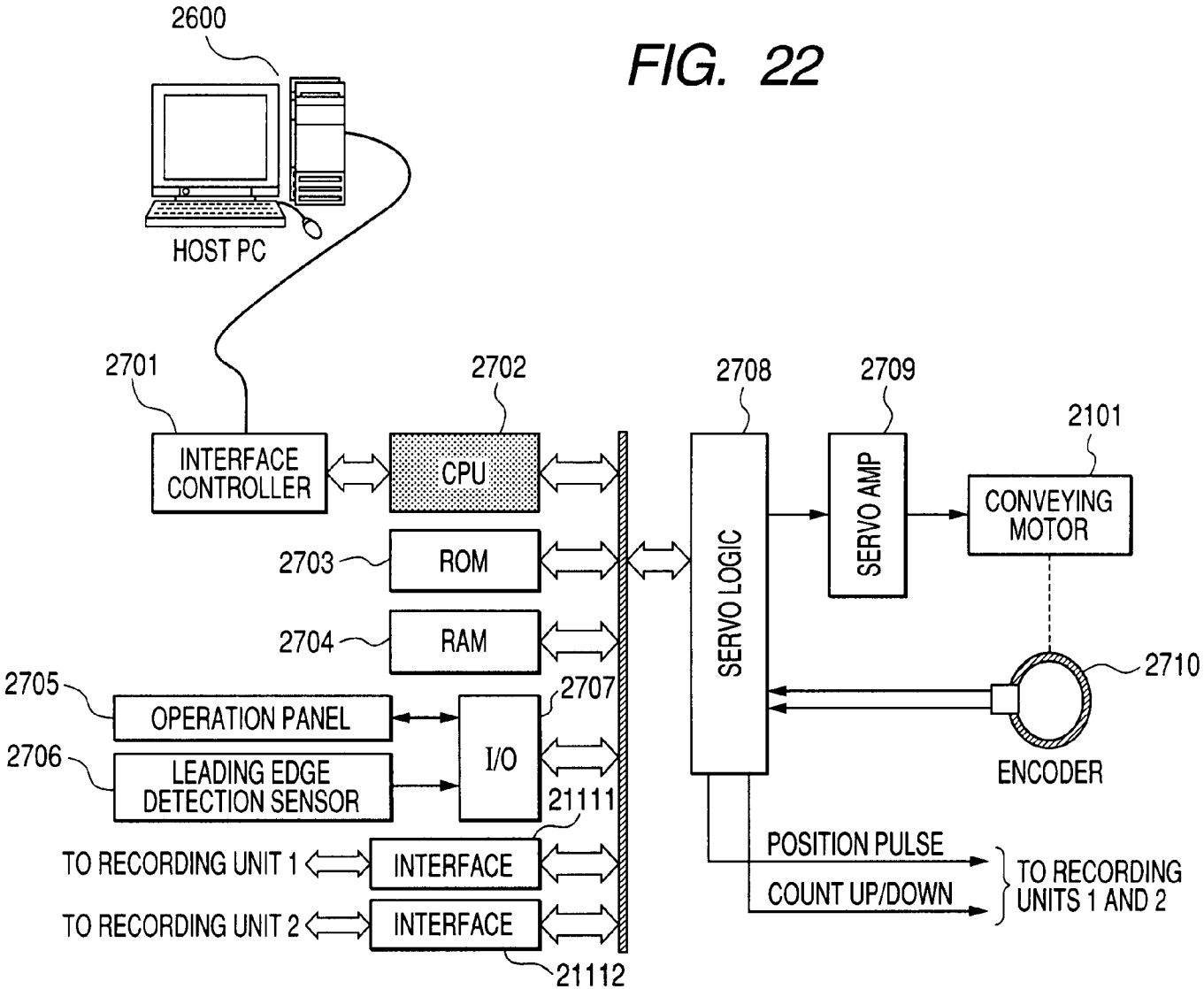
FIG. 22 is an electrical block diagram of the conveying apparatus.

FIG. 22 is an electrical block diagram of the conveying apparatus 2601 for handling the recording medium 2204.

A command for starting or stopping the conveying of the recording medium 2204 is received from the host PC 2600 through a USB interface controller, and a CPU 2702 analyzes the command.

Upon receiving a conveying start command, a conveying speed instruction etc. are written into a servo logic 2708 for instructing a start of operation. Then the conveying motor 2101 is activated through a servo amplifier 2709 to enter a constant-speed conveying control at an instructed speed, for example 400 mm/sec.

The speed control is executed by the servo logic 2708 itself, by feeding back an output of a rotary encoder 2710, coupled to the rotary shaft of the conveying motor 2101, to the servo logic 2708.

Thereafter, when a recording medium 2204 reaches the conveying part from an unillustrated roll paper supply part and a front end is detected by a sheet front end sensor 2706, the servo logic starts to emit a count-up signal and a position pulse signal. The count up/down signal and the position pulse signal are formed by converting and synchronizing the output of the encoder 2710, and the position pulse signal is outputted, at a same rate as the resolution of the recording head, by 600 pulses when the recording medium 2204 proceeds by 1 inch. The count up/down signal assumes a high level while the recording medium 2204 is conveyed in the forward normal direction, and a low level during a back feed in the reverse direction. The count-up signal and the position pulse signal are also used for real-time raster cut-out for the recording units 1 and 2.

An operation panel 2705 is equipped with a display such as an LCD and various operations keys and is used for manual power on/off, start/stop of operations and monitoring of the operation status of the apparatus.

Interfaces 2711, 2712 are communication interfaces with recording units, and executes transmission/reception of the respective statuses and an automatic switching of the recording speed (conveying speed).

As the recording medium 2204 is large-sized, there may also be employed sheet suction means (not shown).

Figure 23:
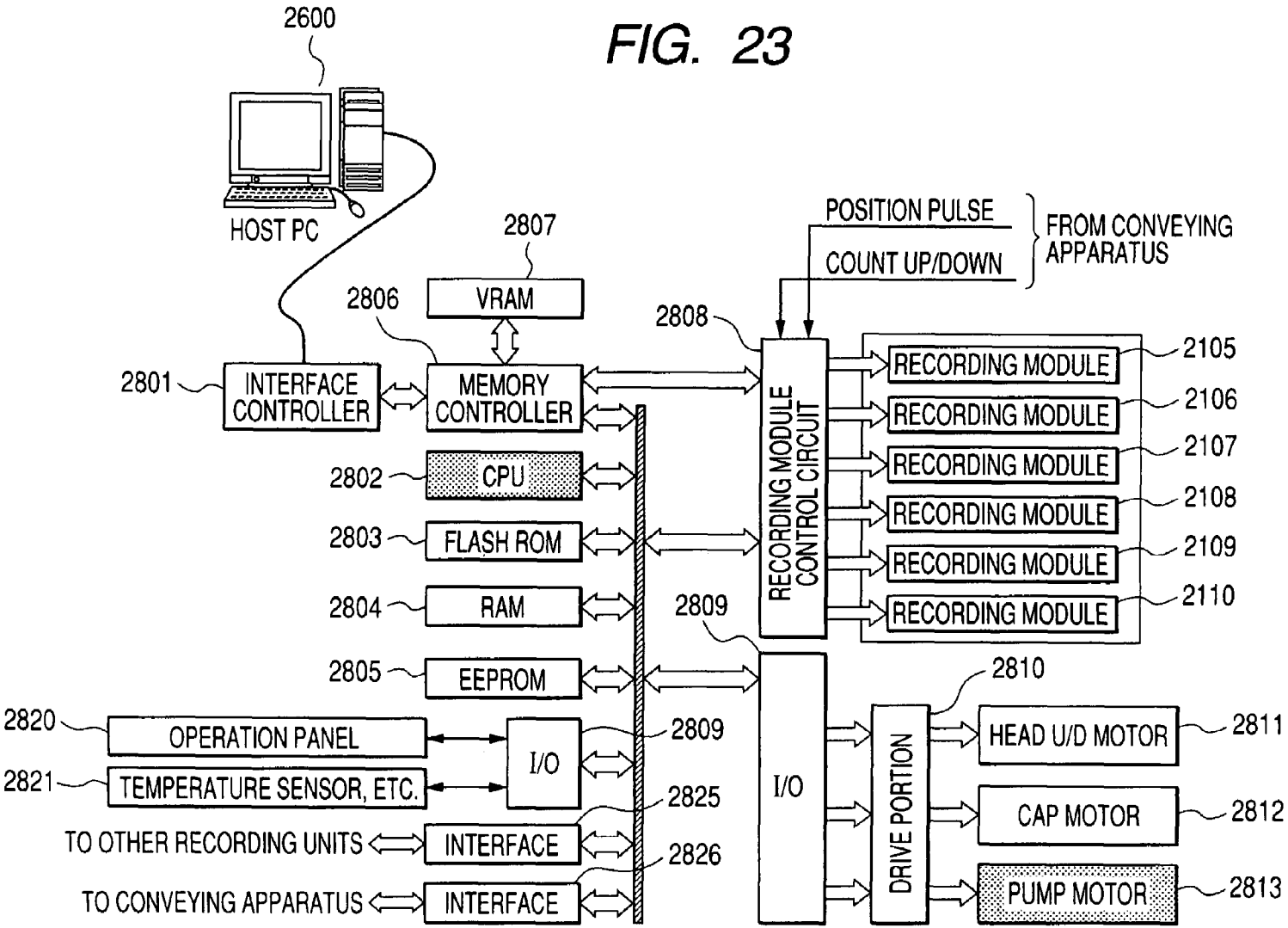
FIG. 23 is a block diagram of a recording apparatus in the above-mentioned embodiment.

FIG. 23 is an electrical block diagram of the recording units 2111, 2121. As both recording units can be realized with a basically same hardware structure, the block diagram is assumed to representatively show the structure of the recording unit 1 (2111).

Image recording data and a command for starting/stopping recording are received from the host PC 2600 for example through the USB interface controller 2801, and the CPU 2802 analyzes the command. The recording data received by the recording units 1, 2 are basically same full image data.

When a recording operation start command is received, recording data are written, under an instruction of the CPU 2802, at a high speed into a VRAM 2807 through the interface controller 2801 and a memory controller 2806. The recording system of the present invention is capable of continuous recording of a continuously varying image, and an amount of the recording data transferred from the host PC 2600 is always larger than an amount of recording data, recorded in a unit time by the recording unit.

Execution programs and various conversion tables for the CPU 2802 are stored in a ROM 2803. Also a RAM 2804 is used as a work memory. Information specific to the recording unit, such as information of all the recording heads in the recording modules 2105-2110, and slight vertical and lateral adjustment data in the recording position (registration data), is stored in a non-volatile EEPROM 2805.

Also relative recording position regulating values for the recording units 1, 2, featuring the present invention, are also stored in the EEPROM 2805.

Upon reception of recording data of a predetermined amount, the head up/down motor 2811 and the capping motor 2812 are activated through a driving part 2810 to shift the recording head from the stand-by state to the recording position as explained in the foregoing, thereby preparing for a recording operation. A pump motor 2813 is used for supplying the recording heads with ink from an unillustrated ink tank, and also for driving an unillustrated pressurizing pump, which, when the recording head is not used over a predetermined period, pressurizes the ink in the recording head thereby forcibly expelling the ink from the nozzles and restoring the proper recording performance.

When the count-up signal and the position pulse signal start to be received from the conveying apparatus, a current position of the recording medium is indicated by an up/down counter provided in a recording module control circuit 2808. When the recording medium reaches the recording start position of each recording module, the recording data are transferred at a high speed from the VRAM 2807, through the memory controller 2806 and the recording module recording circuit 2808, to the recording modules 2105-2110. The VRAM 2807 has a FIFO (first-in-first-out) structure and is refreshed to new reception data in succession from the area of already recorded data.

When both recording units 2111, 2121 share the recording operation, by causing the recording unit 2111 to record for example odd-numbered rasters (null data being transferred for the even-numbered rasters) and by causing the other recording unit 2121 to fill in the even-numbered rasters, a twice recording speed (conveying speed) can be realized in comparison with a case where only one recording head is active and the other recording head is in a cleaning operation.

An operation panel 2820 is provided with operation keys for example for power on/off and for forced stop. A temperature sensor 2821 is provided in the recording unit, but other unillustrated sensors are also provided in the recording module. An input/output port 2809 is used for identifying inputs from sensors and operation keys, and outputting an instruction for a wiping operation to the recording module.

Interfaces 2825, 2826 are used for communication with the other recording unit 2121 and with the conveying apparatus 2601, particularly for confirming mutual statuses in order that a recovery operation (cleaning operation) does not overlap with that of the other recording unit 2121.

Also each of the recording modules 2105-2110 may be provided with a sub CPU.

According to the present invention, in case a cleaning operation is required in the recording heads during a recording operation, the image recording position remains aligned after either recording unit enters the cleaning operation and then returns to the recording operation.

Figures 24, 24A:
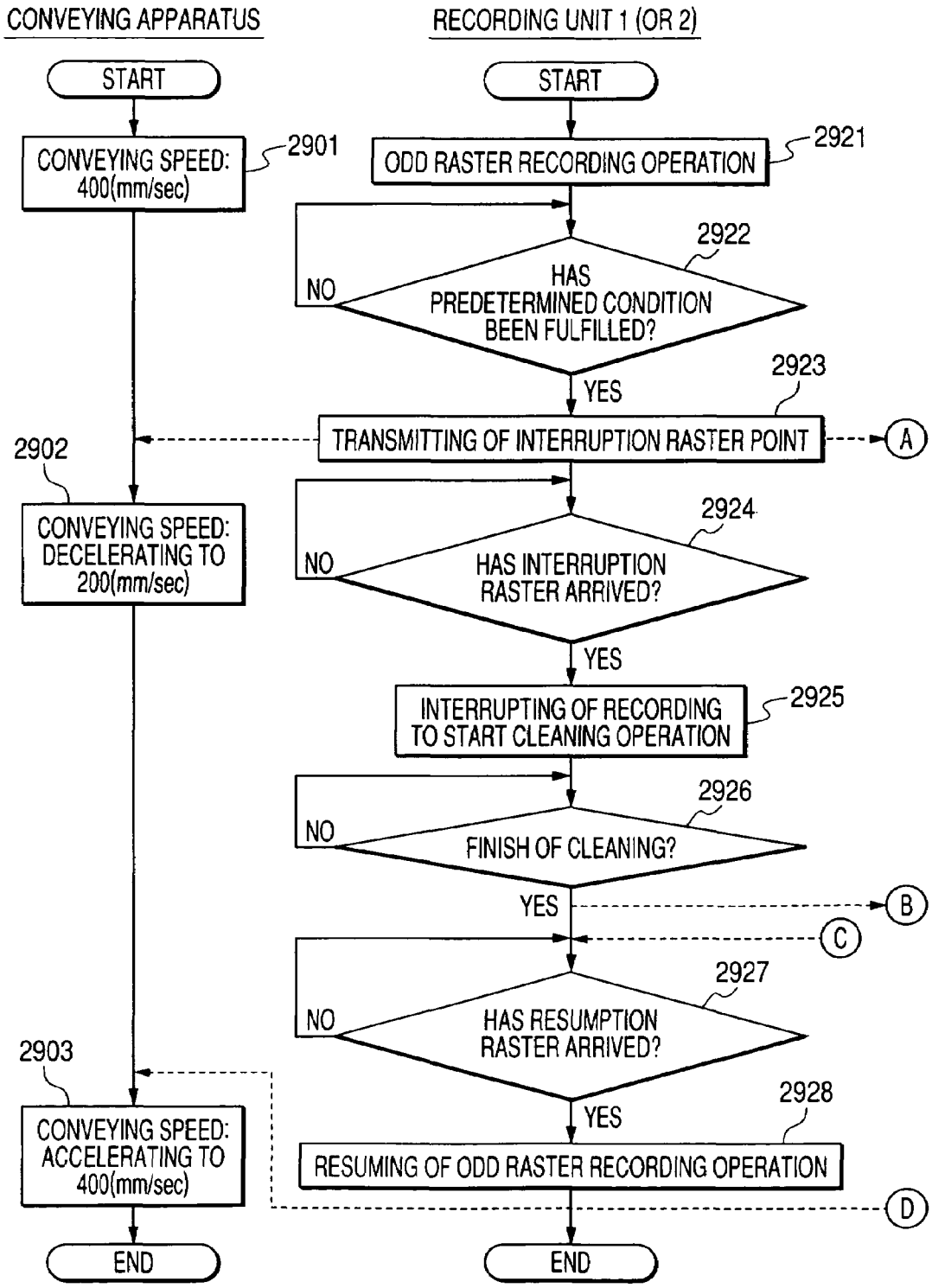
FIG. 24 comprised of FIGS. 24A and 24B illustrating flow charts showing functions of a CPU of the recording apparatus.
Figure 24B:
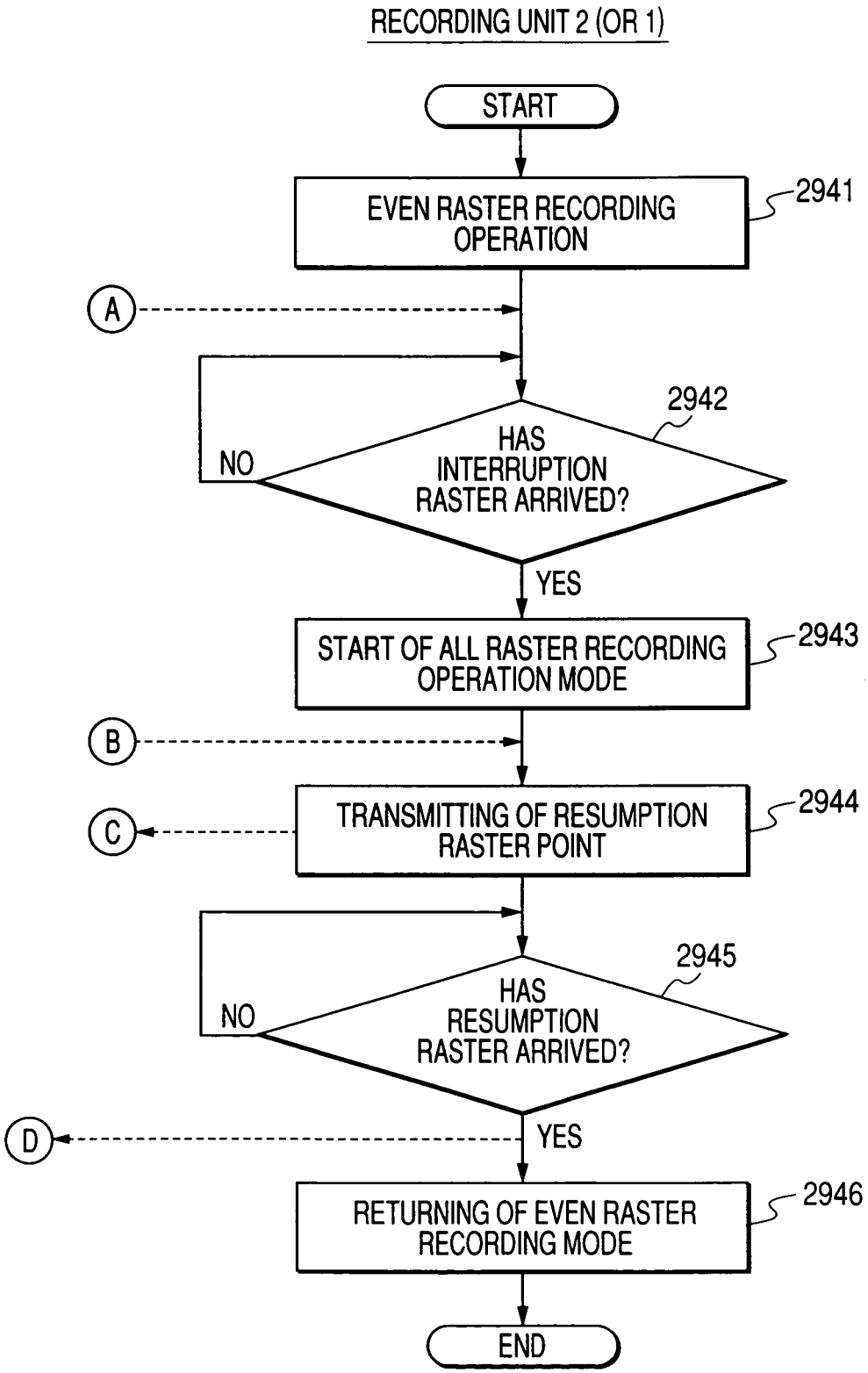

Now reference is made to an operation flow chart shown in FIGS. 24A and 24B, for explaining the mutual operations of the conveying apparatus and the recording units.

In the beginning, a high-speed recording operation is executed (2901) by the recording unit 1 (2111) for the odd-numbered rasters (2921) and by the recording unit 2 (2121) for the even-numbered rasters (2941), with a conveying speed of the conveying apparatus for example of 400 mm/sec. The raster means a height of one dot, corresponding to a row across the width of the sheet.

When the recording operation proceeds and enters a predetermined condition for cleaning (for example a lapse of 1 minute) (2922), the recording unit 1 (2111), in order to inform that the recording is to be soon interrupted, transmits an interrupting raster point (raster number) to the recording unit 2 (2121) and the conveying apparatus 2601 (2623).

In response, the conveying apparatus starts to reduce the conveying speed to a low speed (for example 200 mm/sec) (2902).

When a position of the recording medium 2204 corresponding to the interrupting raster passes under the recording head of the recording unit 1 (2924), the recording unit 1 interrupts the recording and immediately shifts to the cleaning operation (2925).

Then, when the position of the recording medium 2204 corresponding to the interrupting raster reaches a position under the recording head of the recording unit 2 (2121) (2942-YES), the recording unit 2 thereafter enters an all-raster recording mode (2943).

When the cleaning operation of the recording unit 1 comes to an end (2926-YES), it is informed from the recording unit 1 to the recording unit 2, which instructs the recording unit 1 of a re-start raster at which the recording is re-started (2944).

When a position of the recording medium 301 corresponding to the re-start raster reaches a position under the head of the recording unit 1 (2927-YES), the recording unit 1 thereafter re-starts the odd-numbered raster recording mode (2928).

Also when the position of the recording medium 2204 corresponding to the re-start raster reaches a position under the head of the recording unit 2 (2945-YES), the recording unit 2 thereafter returns from the all-raster recording mode to the even-numbered raster recording mode (2946). The recording unit 2 informs the conveying apparatus of restoring the ordinary recording mode by both the recording units 1, 2, whereupon the conveying apparatus starts to elevate the conveying-speed from 200 mm/sec to 400 mm/sec (2903), whereby the original recording mode is restored.

The above-explained procedure is similarly executed also when the recording unit 2 enters a cleaning operation.

Fourth Embodiment

Figure 25:
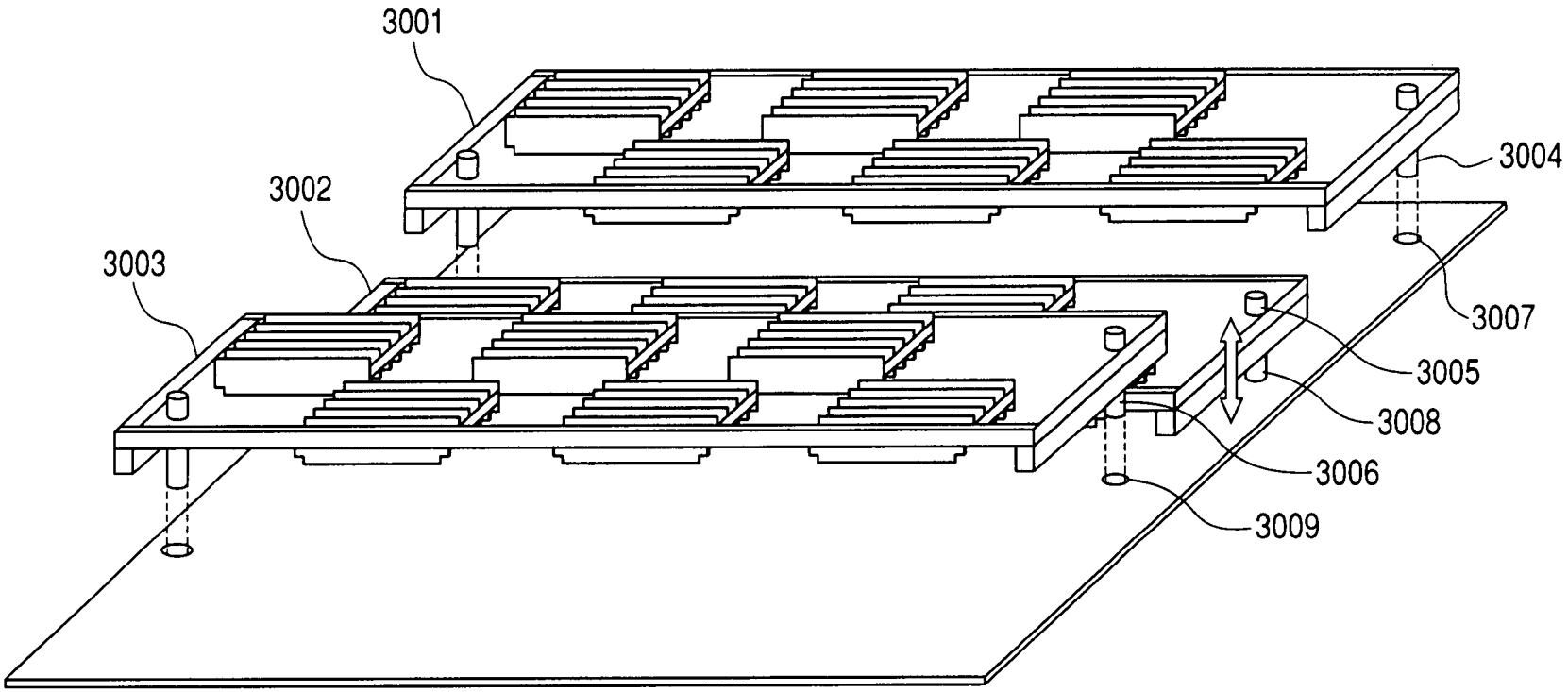
FIG. 25 is a schematic view showing a fourth embodiment employing three sets of recording units.

In contrast to the third embodiment for a recording apparatus executing a continuous recording with two recording units 2111, 2121, the present embodiment is provided with three recording units 3001, 3002, 3003 as shown in FIG. 25. In comparison with the foregoing third embodiment, the entire recording system occupies a larger space in the sheet conveying direction, and requires a stricter control for the recording precision, but the recording units 3001-3003 are respectively equipped with positioning pins 3004, 3005, 3006 and the fixed platen is provided with guide portions 3007, 3008, 3009.

Such pins and guide portions have forms similar to those of the third embodiment explained in FIGS. 19A to 19C. FIG. 25 shows a state where the recording unit 3002 is in a recording position while the recording units 3001, 3003 are lifted up for cleaning, but it is naturally more efficient to execute the recording operation constantly with at least two recording units, and to execute the cleaning operation for one recording unit at a time, on time-shared basis. The present embodiment can realize, by the positioning means of the present invention, a recording system of an even higher image quality and an even higher productivity.

As explained above, the present invention is applicable to a recording system for recording on a relatively large-sized object, such as corrugated cardboard, at a high speed, an image of an extremely high quality with a high reliability.

What is claimed is:

1. A recording system comprising:

a first recording unit including a recording module having a recording head and cleaning means which cleans the recording head;

conveying means which conveys a recording medium; and at least a second recording unit provided at a downstream side of the first recording unit in a conveying direction of the recording medium, wherein the first recording unit records a first image portion and the second recording unit records a second image portion, and wherein the first and second recording units receive same recording data, and the system further comprises recording data masking means which masks recording data of a predetermined area.

2. A recording system according to claim 1, wherein, when both the first and second recording units execute a recording operation, the recording data masking means of the respective recording units mask the recording data in every other raster and in a mutually alternate manner.

3. A recording system according to claim 1, wherein, when both the first and second recording units execute a recording operation, the recording data masking means of the respective recording units mask the recording data in every predetermined number of rasters.

4. A recording system according to claim 1, wherein, when both the first and second recording units execute a recording operation, the recording data masking means of the respective recording units mask the recording data in a checkerboard pattern.

5. A recording system according to claim 1, wherein a cleaning operation of the cleaning means involves a wiping operation of a recording head by a wiper blade.

6. A recording system according to claim 1, wherein the recording module includes plural recording heads which execute recording with inks of different colors.

7. A recording system according to claim 1, wherein the recording module includes plural recording heads which execute recording with inks of a same color.

8. A recording system according to claim 1, further comprising cleaning operation control means which independently controls cleaning operations of the first and second recording units.

9. A recording system according to claim 1, further comprising conveying speed setting means which sets a conveying speed of the recording medium, in a state where the first and second recording units are not in a cleaning operation, to be greater than a conveying speed during a cleaning operation.

10. A recording system comprising:

a first recording unit including a recording module having a recording head and cleaning means which cleans the recording head;

conveying means which conveys a recording medium;

at least a second recording unit provided at a downstream side of the first recording unit in a conveying direction of the recording medium; and recording interruption advance notice signal transmission means which gives an advance notice for the interruption of the recording operation prior to a cleaning operation of the first or second recording unit, wherein the first recording unit records a first image portion and the second recording unit records a second image portion.

11. A recording system according to claim 10, further comprising conveying speed decreasing means which, in case a recording interruption advance notice signal is released from the recording interruption advance notice signal transmission means, decreases the conveying speed of the recording medium.

12. A recording system according to claim 11, wherein, after the decrease of the conveying speed of the recording medium, the first and second image portions are recorded by the first or second recording unit.

13. A recording system according to claim 10, wherein the recording interruption advance notice signal transmission means transmits an interruption start raster on the recording medium.

14. A recording system according to claim 13, wherein the interruption start raster on the recording medium, transmitted from the recording interruption advance notice signal transmission means, is at or after a start point of a decrease to the conveying speed set by conveying speed decreasing means.

15. A recording system comprising:

a first recording unit including a recording module having a recording head and cleaning means which cleans the recording head;

conveying means which conveys a recording medium;

at least a second recording unit provided at a downstream side of the first recording unit in a conveying direction of the recording medium; and recording restart advance notice signal transmission means which gives an advance notice for a restart of the recording operation after a cleaning operation of the first or second recording unit, wherein the first recording unit records a first image portion and the second recording unit records a second image portion.

16. A recording system according to claim 15, wherein, after a recording restart advance notice signal is transmitted from the recording restart advance notice signal transmission means, the system returns to a recording mode in which the first or second recording unit records the first or second image portion and the second or first recording unit records the second or first image portion.

17. A recording system according to claim 16, further comprising conveying speed increasing means which, after returning to the recording mode, increases the conveying speed of the recording medium.

18. A recording system according to claim 15, wherein the recording restart advance notice signal transmission means transmits a recording restart raster on the recording medium.

19. A recording system according to claim 18, wherein the recording restart raster, transmitted from the recording restart advance notice signal transmission means, is at least before an end of an increase of the conveying speed by conveying speed increasing means.

* * * * *